US007817936B2

(12) United States Patent
Kikuchi et al.

(10) Patent No.: US 7,817,936 B2
(45) Date of Patent: Oct. 19, 2010

(54) COLOR ELECTROPHOTOGRAPHIC IMAGE FORMING APPARATUS

(75) Inventors: Ken Kikuchi, Mishima (JP); Tsutomu Nishiuwatoko, Numazu (JP); Takashi Akutsu, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 70 days.

(21) Appl. No.: 12/370,298

(22) Filed: Feb. 12, 2009

(65) Prior Publication Data

US 2010/0158559 A1 Jun. 24, 2010

(30) Foreign Application Priority Data

Dec. 18, 2008 (JP) ..... 2008-322012

(51) Int. Cl.
*G03G 15/00* (2006.01)

(52) U.S. Cl. ..... 399/110; 399/111; 399/120

(58) Field of Classification Search ..... 399/107, 399/110, 111, 114, 119, 120, 252, 258, 262
See application file for complete search history.

(56) References Cited

U.S. PATENT DOCUMENTS

| | | | | |
|---|---|---|---|---|
| 5,870,655 | A | 2/1999 | Nishiuwatoko et al. | 399/111 |
| 5,893,006 | A | 4/1999 | Kanno et al. | 399/13 |
| 6,070,029 | A | 5/2000 | Nishiuwatoko et al. | 399/111 |
| 6,735,405 | B2 | 5/2004 | Yokoi et al. | 399/109 |
| 6,832,057 | B2 | 12/2004 | Oguma et al. | 399/27 |
| 6,952,544 | B2 | 10/2005 | Kikuchi et al. | 399/109 |
| 7,073,251 | B2 | 7/2006 | Kikuchi et al. | 29/729 |
| 7,079,787 | B2 | 7/2006 | Ogino et al. | 399/111 |
| 7,296,341 | B2 | 11/2007 | Kikuchi et al. | 29/729 |
| 2007/0160388 | A1 | 7/2007 | Yoshimura et al. | 399/111 |
| 2007/0177886 | A1 * | 8/2007 | Taguchi et al. | 399/12 |
| 2007/0280730 | A1 | 12/2007 | Okabe et al. | 399/111 |
| 2009/0041498 | A1 * | 2/2009 | Numagami et al. | 399/111 |

FOREIGN PATENT DOCUMENTS

| | | |
|---|---|---|
| JP | 09-044055 | 2/1997 |
| JP | 2002-278414 | 9/2002 |
| JP | 2003-156910 | 5/2003 |
| JP | 2006-085064 | 3/2006 |
| JP | 2007-322554 | 12/2007 |

* cited by examiner

*Primary Examiner*—Hoan Tran
(74) *Attorney, Agent, or Firm*—Fitzpatrick, Cella, Harper & Scinto

(57) ABSTRACT

A color electrophotographic image forming apparatus in which a plurality of cartridges are detachably mounted to an apparatus main body to form an image on a recording medium, including: a cartridge supporting member, which moves between an inside position that is positioned inside the apparatus main body and a pullout position pulled out from the inside position to an outside of the apparatus main body, while detachably supporting the plurality of cartridges; in which the plurality of cartridges are arranged side-by-side and supported on the cartridge supporting member so that a longitudinal direction of each of the plurality of cartridges is orthogonal to a pullout direction in which the cartridge supporting member moves from the inside position to the pullout position, and a cartridge, which is heaviest among the plurality of cartridges, is supported most upstream in the pullout direction.

12 Claims, 17 Drawing Sheets

COLOR ELECTROPHOTOGRAPHIC IMAGE FORMING APPARATUS

BACKGROUND OF THE INVENTION

1. Field of the Invention

The present invention relates to a color electrophotographic image forming apparatus, in which a plurality of cartridges are detachably mounted to an apparatus main body to form an image on a recording medium.

2. Description of the Related Art

Here, the color electrophotographic image forming apparatus forms a color image on a recording medium by using an electrophotographic image forming process. Then, examples of the color electrophotographic image forming apparatus include, for example, a color electrophotographic copying machine, a color electrophotographic printer (for example, such as a color laser beam printer and a color LED printer), a color facsimile machine, and a color word processor.

Besides, the recording medium is one on which an image is to be formed by the electrophotographic image forming apparatus, and paper, an OHP sheet, and the like are included therein, for instance.

Further, a cartridge is, for example, a process cartridge or a developing cartridge, and contributes, in a state being detachably mounted to a main body of the electrophotographic image forming apparatus, to an image forming process for forming the image on the recording medium. Here, in the above-mentioned process cartridge, at least one of a charging means, a developing means, and a cleaning means each serving as a process means and an electrophotographic photosensitive drum are integrated into a cartridge, which is detachably mountable to the main body. Therefore, a process cartridge into which the developing means serving as the process means and the electrophotographic photosensitive drum are integrated, may be detachably mountable to the main body of the electrophotographic image forming apparatus. In addition, a process cartridge into which the charging means, the developing means, or the cleaning means each serving as the process means and the electrophotographic photosensitive drum are integrated, may be detachably mountable to the main body. Note that, the process cartridge, which integrally includes the electrophotographic photosensitive drum and the developing means, is referred to as a so-called integral type. Further, the process cartridge, which integrally includes the electrophotographic photosensitive drum and the process means other than the developing means, is referred to as a so-called separation type. That is, the developing means is provided in a developing unit, which is separated from the process cartridge, and the image formation is performed through a pair of the developing unit and the process cartridge. The process cartridge is referred to as the so-called separation type.

In this case, the process cartridge can detachably mounted to the main body by a user in person. Accordingly, the user can easily perform maintenance of the apparatus main body. Note that, the process means acts on the electrophotographic photosensitive drum.

Further, the developing cartridge includes a developing roller, contains a developer (toner) used to develop an electrostatic latent image formed on the electrophotographic photosensitive drum by the developing roller, and is detachably mountable to the main body. In a case of the developing cartridge, the electrophotographic photosensitive drum is mounted to the apparatus main body or a cartridge supporting member described below. Alternatively, the electrophotographic photosensitive drum is provided in the so-called separation type process cartridge (in this case, the process cartridge has no developing means). Note that, the developing cartridge is also detachably mountable to the main body by the user in person. For that reason, the maintenance of the apparatus main body may easily be performed.

Then, as the cartridge, the so-called integral type or the so-called separation type process cartridge may be used. Further, as the cartridge, the so-called separation type process cartridge and the developing cartridge may be used as a pair. Further, there may include a case in which, as the cartridge, the electrophotographic photosensitive drum is fixed and mounted to the apparatus main body or the cartridge supporting member described below, and the developing cartridge is detachably used so as to be capable of acting on the electrophotographic photosensitive drum. Still further, the above-mentioned cartridge includes a developer cartridge containing a developer (toner) to be supplied to the process cartridge or the developing cartridge.

As described above, hitherto, there is known the electrophotographic image forming apparatus, which forms a color image on the recording medium using the electrophotographic image forming process. In the electrophotographic image forming apparatus, there is known the above-mentioned process cartridge system. Alternatively, there is known a developing cartridge system, which is constructed only by the above-mentioned developing unit as a separate member from the photosensitive drum. There is also known the above-mentioned developer cartridge system containing the developer. The above-mentioned process cartridge system, developing cartridge system, and developer cartridge system are all inclusively referred to as the cartridge systems.

Note that, the above-mentioned process cartridge and developing cartridge each includes a developer containing portion for containing the developer (toner) used to develop the electrostatic latent image.

On the other hand, in order to facilitate a replacement of the cartridge by the user, there is provided a pullout drawer (cartridge supporting member) for supporting a plurality of cartridges. Then, the pullout drawer is pulled out from an inside of the main body to a predetermined position, thereby allowing the replacement of each of the cartridges. This structure is disclosed in U.S. Patent Application Publication No. 2007/0160388.

SUMMARY OF THE INVENTION

The present invention further evolves the above-mentioned conventional structure.

It is an object of the present invention to provide a color electrophotographic image forming apparatus, which is improved in its operability for mounting and detaching a cartridge from an apparatus main body.

It is another object of the present invention to provide a color electrophotographic image forming apparatus in which, at an initial setting, when a cartridge supporting member supporting a plurality of cartridges is pulled out from the apparatus main body, tilting of the supporting member itself due to weight of the cartridges is hard to cause.

It is another object of the present invention to provide a color electrophotographic image forming apparatus capable of reducing a degree of rigidity enhancement for enhancing a rigidity of the apparatus main body in order to prevent the supporting member under a pulled out state from tilting down due to the gravitational force when the supporting member is pulled out from the apparatus main body.

A typical structure of the image forming apparatus according to the present invention for attaining the above-mentioned objects is characterized by a color electrophotographic image forming apparatus in which a plurality of cartridges are detachably mounted to an apparatus main body to form an image on a recording medium, the color electrophotographic image forming apparatus comprising a cartridge supporting member detachably supporting the plurality of cartridges and movable between an inside position in which the cartridge supporting member is inside the apparatus main body and a pullout position in which the cartridge supporting member is pulled out from the inside position to an outside of the apparatus main body, wherein the plurality of cartridges are arranged side-by-side and supported on the cartridge supporting member so that a longitudinal direction of each of the plurality of cartridges orthogonal to a pullout direction in which the cartridge supporting member moves from the inside position to the pullout position, and a cartridge, which is heaviest among the plurality of cartridges, is supported most upstream of the pullout direction.

According to the present invention, it is possible to provide the color electrophotographic image forming apparatus, which enhances the operability for mounting and detaching the cartridge from the apparatus main body.

According to the present invention, it is possible to provide the color electrophotographic image forming apparatus in which, when the cartridge supporting member supporting the plurality of cartridges is pulled out from the apparatus main body, the tilting of the supporting member itself due to the weight of the cartridges is hard to cause.

According to the present invention, it is possible to provide the color electrophotographic image forming apparatus capable of reducing the degree of rigidity enhancement for enhancing the rigidity of the apparatus main body in order to prevent the supporting member in the pulled out state from tilting down due to the gravitational force when the supporting member is pulled out from the apparatus main body.

Further features of the present invention will become apparent from the following description of exemplary embodiments with reference to the attached drawings.

BRIEF DESCRIPTION OF THE DRAWINGS

FIGS. 10A and 11B are explanatory diagrams illustrating a structure of the pullout member.

DESCRIPTION OF THE EMBODIMENTS

Hereinafter, embodiments of the present invention are described in detail with reference to the drawings. However, unless otherwise specifically described, dimensions, materials, shapes, relative arrangements, and the like of components described in the embodiments are not intended to limit a scope of the present invention thereto.

First Embodiment (General Schematic Structure of Color Electrophotographic Image Forming Apparatus)

Figure 1:
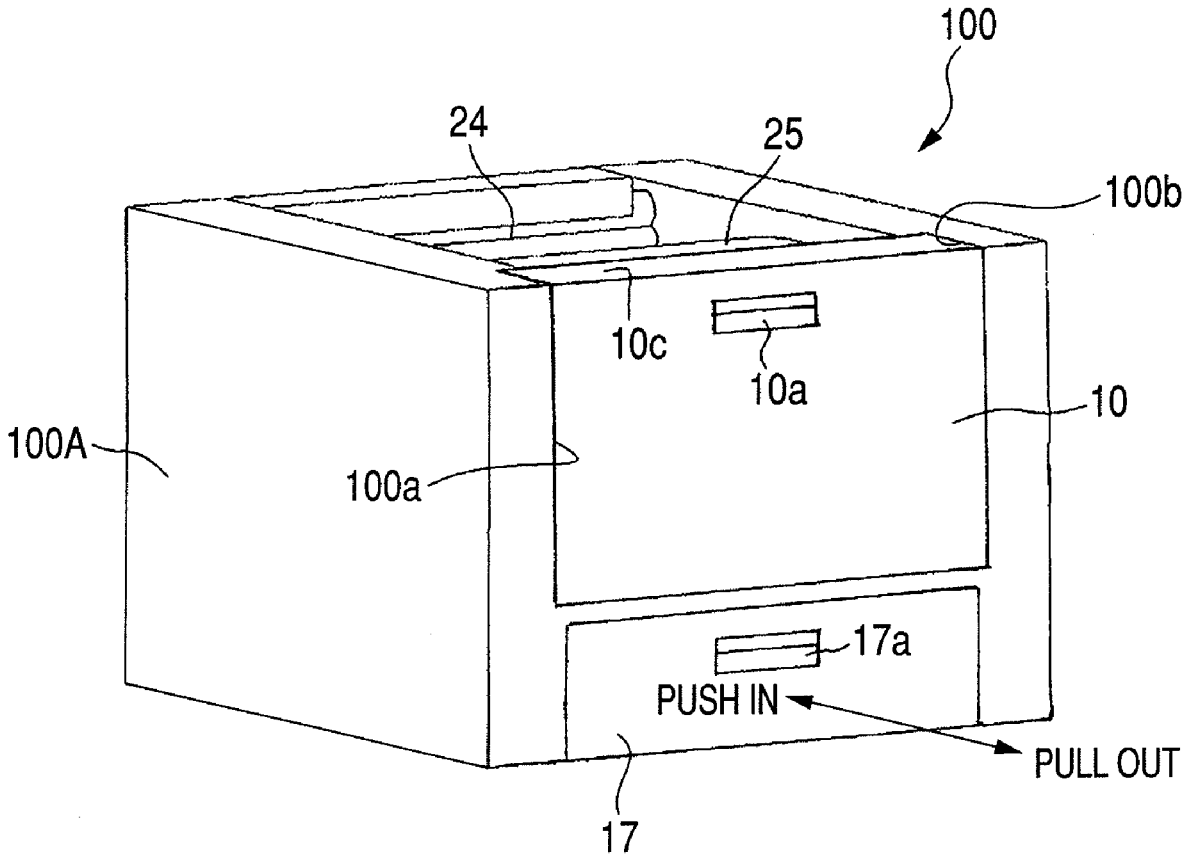
FIG. 1 is an external perspective view of an image forming apparatus according to a first embodiment of the present invention.
Figure 2:
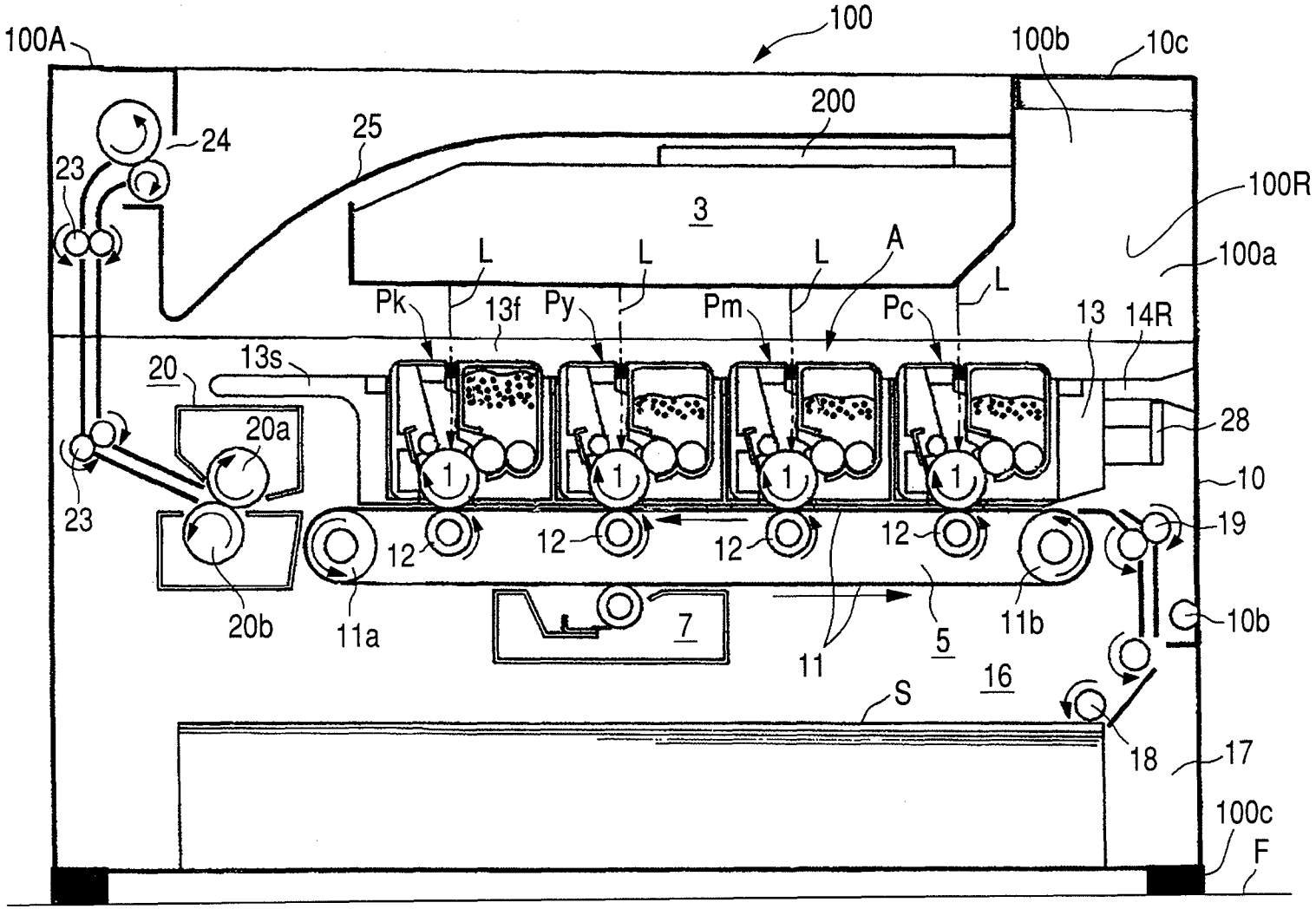
FIG. 2 is a schematic vertical sectional right side view of the image forming apparatus.
Figure 3:
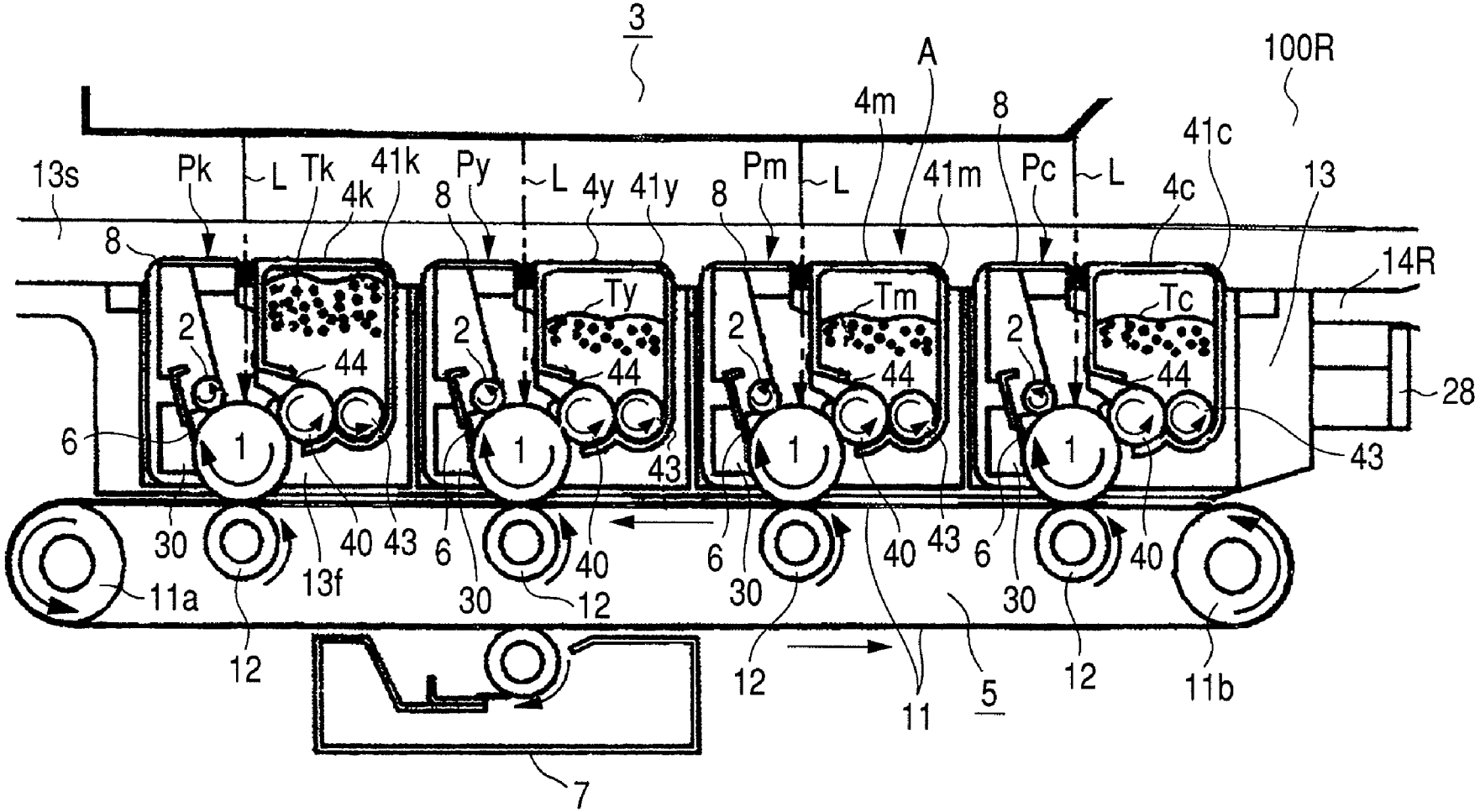
FIG. 3 is a partially enlarged view of FIG. 2.

FIG. 1 is an external perspective view of a color electrophotographic image forming apparatus (hereinafter, referred to as an image forming apparatus) 100 according to this embodiment, FIG. 2 is a schematic vertical sectional right side view of the image forming apparatus 100, and FIG. 3 is a partially enlarged view of FIG. 2. The image forming apparatus 100 is a four-full-color laser beam printer using an electrophotographic process. Specifically, the image forming apparatus 100 conducts a full color image formation with respect to a recording medium S on the basis of an electrical image signal, which is input from a host apparatus (not shown) such as a personal computer, an image reader, a facsimile on the other side, and the like to a control circuit portion 200.

In the following description, regarding the image forming apparatus 100, a forward side or a front side refers to a side on which a door 10 for opening and closing the apparatus is arranged. A rear side refers to an opposite side thereto. A front-rear direction refers to a direction from the rear side toward the front side of the image forming apparatus (front direction), and an opposite direction thereto (rear direction). A left and right refers to a left or a right when the image forming apparatus is viewed from the front side. A lateral direction refers to a direction from right toward left (left-hand direction) and an opposite direction thereto (right-hand direction). Further, an apparatus main body 100A refers to an image forming apparatus portion excluding the cartridges.

The image forming apparatus 100 described in this embodiment is a so-called lateral tandem type, in which four process cartridges P (Pk, Py, Pm, and Pc) for forming developer images (toner images) of respective black (k), yellow (y), magenta (m), and cyan (c) colors, are arranged in a lateral direction. In the image forming apparatus 100, the plurality of cartridges P are detachably mounted to the apparatus main body 100A to form a color image on a recording medium S.

Specifically, in an inside of the apparatus main body 100A, a first to fourth four process cartridges P (Pk, Py, Pm, and Pc) are arranged side-by-side substantially horizontally in order from a rear side to a front side. Each of the process cartridges (hereinafter referred to as a cartridge) P includes an electrophotographic photosensitive drum 1 (hereinafter referred to as a drum) on which an electrostatic latent image is formed. The drum 1 is rotatingly driven in clockwise as indicated by an arrow. At the periphery of the drum 1, a charging means 2, a developing means 4 (4*k*, 4*y*, 4*m*, and 4*c*), and a drum cleaning means 6 as process means acting on the drum are arranged in order of mention along a rotation direction of the drum 1.

It should be noted that, in this embodiment, description is made by taking as an example of the cartridge a so-called integral type process cartridge described above, but the present invention is not limited thereto.

The drum 1 is obtained by coating, for example, an organic photoconductive layer (OPC photoconductor) onto an outer peripheral surface of an aluminum cylinder.

The charging means (process means) 2 employs a contact charging system, in which a charging roller (conductive roller formed into a roller shape) is used as a charging member. The charging roller 2 is arranged substantially in parallel to and abutting the drum 1, and is rotated in association with the rotation of the drum 1. Then, the surface of the drum 1 is uniformly charged with a predetermined polarity and electric potential through an application of a predetermined charging bias voltage to the charging roller 2 from a power supply section (not shown).

The developing means (process means) 4 is a developing unit, which develops the electrostatic latent image formed on the drum 1 by using a developer (toner). The developing units 4 (4*k*, 4*y*, 4*m*, and 4*c*) of the respective cartridges P each includes a developer containing portion 41 (41*k*, 41*y*, 41*m*, 41*c*) containing a developer T (Tk, Ty, Tm, Tc) and a developing roller 40 as a developing member with respect to the drum 1. In addition, each developing unit 4 includes a developer supply roller 43 as a developer applying member with respect to the developing roller 40 and a developing blade as a developer restricting member which is brought into pressure contact with an outer periphery of the developing roller 40.

The drum cleaning means (process means) 6 is a cleaning member, which removes a transfer residual developer from a surface of the drum 1 after the transfer of the developer image formed on a peripheral surface of the drum 1 to a sheet of the recording medium S. In this embodiment, a cleaning blade is used as the cleaning member. The developer removed from the drum surface is received in a removed developer container portion 30.

Each of the cartridges P is constructed by combining a photosensitive unit 8 including the drum 1, the charging roller 2, and a drum cleaning means 6 with the developing units 4 (4*k*, 4*y*, 4*m*, and 4*c*). Then, the respective cartridges P are detachably replaceable with respect to the apparatus main body 100A with a pullout system. Further detailed structure of the cartridges P and the pullout system are described later.

A first cartridge Pk has a structure in which a developer Tk of black color (k-color) is contained in the developer containing portion 41*k* of the developing unit 4*k*, and a developer image of black color is formed on a surface of the drum 1. A second cartridge Py has a structure in which a developer Ty of yellow color (y-color) is contained in the developer containing portion 41*y* of the developing unit 4*y*, and a developer image of yellow color is formed on the drum 1. A third cartridge Pm has a structure in which a developer Tm of magenta color (m-color) is contained in the developer containing portion 41*m* of the developing unit 4*m*, and a developer image of magenta color is formed on the drum 1. A fourth cartridge Pc has a structure in which the developer Tc of cyan color (c-color) is contained in the developer containing portion 41*c* of the developing unit 4*c*, and a developer image of cyan color is formed on the drum 1.

On an upper side of the cartridges P (Pk, Py, Pm, Pc) mounted inside of the apparatus main body 100A, a laser scanner unit 3 as an image exposing means is arranged. Besides, on the lower side thereof, an electrostatic transfer belt unit 5 as a transfer means is arranged.

The laser scanner unit 3 includes a laser diode, a polygon mirror, an Fθ lens, a reflection mirror, and the like, and outputs a laser beam L which has been modulated in correspondence with image information of each color, which is input from a host apparatus to a control circuit portion 200, to thereby scan and expose the charged surface of the drum 1. With this operation, an electrostatic latent image, which corresponds to a scanning and exposing pattern is formed on the surface of the drum 1.

The belt unit 5 includes an endless electrostatic transfer belt (hereinafter referred to as a belt) 11, which is formed of a dielectric body and having a flexibility. Further, the belt unit 5 includes a first roller 11*a* of the rear side and a second roller 11*b* of the front side, around which the belt 11 is wrapped and stretched. In addition, the belt unit 5 includes four transfer rollers 12, which are arranged inside the belt 11 and between the first roller 11*a* and the second roller 11*b*, and are brought into pressure contact with the drums 1 of the respective cartridges P, while sandwiching the belt 11 therebetween. In the respective cartridges P, a contact portion between the drum 1 and the belt 11 constitutes a transfer nip portion. When the first roller 11*a* is driven, the belt 11 rotates in a counterclockwise direction (a direction indicated by the arrow in FIG. 2 and FIG. 3) as a speed corresponding to a rotation speed of the drum 1. On the lower surface side of the belt 11, there is provided a belt cleaning means 7.

Operation for forming a full-color image is as follows. The cartridges P are sequentially driven at predetermined control timing. Specifically, the respective drums 1 are rotatingly driven in a clockwise direction (a direction indicated by the arrow in FIG. 2 and FIG. 3). The belt 11 of the belt unit 5 is also rotatingly driven. The laser scanner unit 3 is also driven. In synchronism with the drive, in each of the cartridges P, the charging roller 2 uniformly charges the surface of the drum 1 to a predetermined polarity and predetermined potential. The scanner unit 3 carries out a laser beam scanning exposure on the surfaces of the respective drums 1 in accordance with corresponding image signals. With this operation, electrostatic latent images are formed on the surfaces of the respective drums 1 in accordance with the corresponding image signals. The formed electrostatic latent images are developed by the developing units 4 (4*k*, 4*y*, 4*m*, and 4*c*) (the development rollers 40). That is, developer images are formed.

With the above-mentioned electrophotographic process operation, a developer image of k-color corresponding to a black component image of a full-color image is formed on the drum 1 of the cartridge Pk. On the drum 1 of the cartridge Py, a developer image of y-color corresponding to a yellow component image of a full-color image is formed. On the drum 1 of the cartridge Pm, a developer image of magenta color corresponding to a magenta component image of a full-color image is formed. On the drum 1 of the cartridge Pc, a developer image of cyan color corresponding to a cyan component image of a full-color image is formed.

On the other hand, a feeding roller 18 of a feeding portion 16 is driven at predetermined control timing, and one sheet of recording medium S is separated and fed from a feeding cassette 17 in which the recording mediums S are contained. The feeding cassette 17 may be freely put in and taken out from the front side of the apparatus main body 100A (front loading). Reference symbol 17*a* denotes a handle portion provided to a front surface of the feeding cassette 17. The fed recording medium S is supplied onto the belt 11 of the belt unit 5 from the front side at predetermined control timing by a registration roller pair 19. The recording medium S fed onto the belt 11 is electro-statically attracted to the belt 11. Then, along with the rotation of the belt 11, the recording medium S is sequentially fed to respective transfer nip portions of the cartridge PC, the cartridge Pm, the cartridge Py, and the cartridge Pk. To the transfer roller 12, there is applied a transfer bias from a power supply (not shown), which is a reverse polarity with respect to a charging polarity of the developer (charging polarity of toner), and has a predetermined potential. With this operation, four-color developer images of c-color+m-color+y-color+k-color are superposed and transferred on the recording medium S. With this operation, an unfixed full-color developer image is formed on the recording medium S.

Then, the recording medium S is separated from the surface of the belt 11 to be introduced to a fixing portion 20. The fixing portion 20 fixes the developer image of a plurality of colors transferred onto the recording medium S. The fixing portion 20 includes a heating roller 20*a* that rotates and a pressure roller 20*b* which is brought into pressure contact with the heating roller 20*a* to apply heat and pressure to the recording medium S. The recording medium S, on which the developer image is formed, is nipped and conveyed by the fixing roller pair 20*a*, 20*b* when passing through the fixing portion 20. Then, heat and pressure are applied to the recording medium S by the fixing roller pair 20*a*, 20*b*. With this operation, the developer image of the plurality of colors is fixed onto the surface of the recording medium S. Then, the recording medium S exits from the fixing portion 20, and is delivered from a delivery portion 24, through a conveying path including a delivery roller pair 23, to a delivery tray 25 outside the apparatus main body, as a full-color image formation product.

Note that, in a case of a monochrome image forming mode, only the image formation using the cartridge Pk is performed.

(Cartridge Replacement System)

Replacements of the respective cartridges P may be performed by a user when the developer is consumed and reached its life end. In the image forming apparatus of this embodiment, the replacement of the cartridge is allowed to perform by front access by mounting the cartridges onto the pullout member 13 as the cartridge supporting member which being a pullout frame member. When attaching and detaching the cartridges P with respect to the apparatus main body 100A, the attachment and detachment of the cartridges P are performed with respect to the pullout member 13 which is in a pullout state outside the apparatus main body 100A. Then, the pullout member 13 supporting the cartridges P is pushed into the apparatus main body 100A. With this operation, the cartridges P may be mounted to predetermined positions within the apparatus main body 100A. Thus, enhancement of the mounting and detaching operability of the cartridges P with respect to the apparatus main body 100A may be attained.

Figure 4:
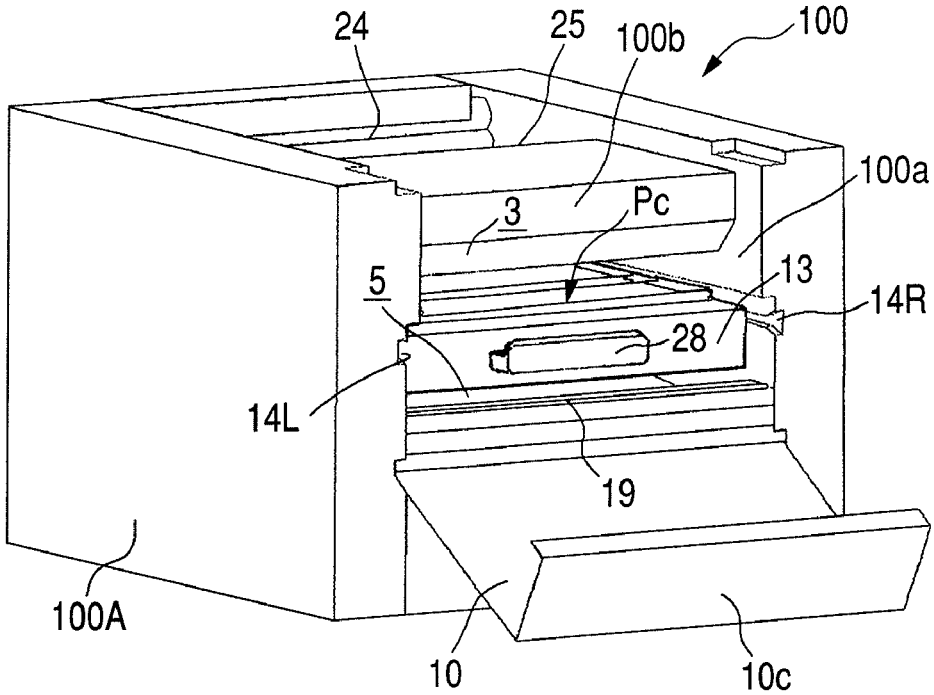
FIG. 4 is an external perspective view of the image forming apparatus in a door opening state.
Figure 5:
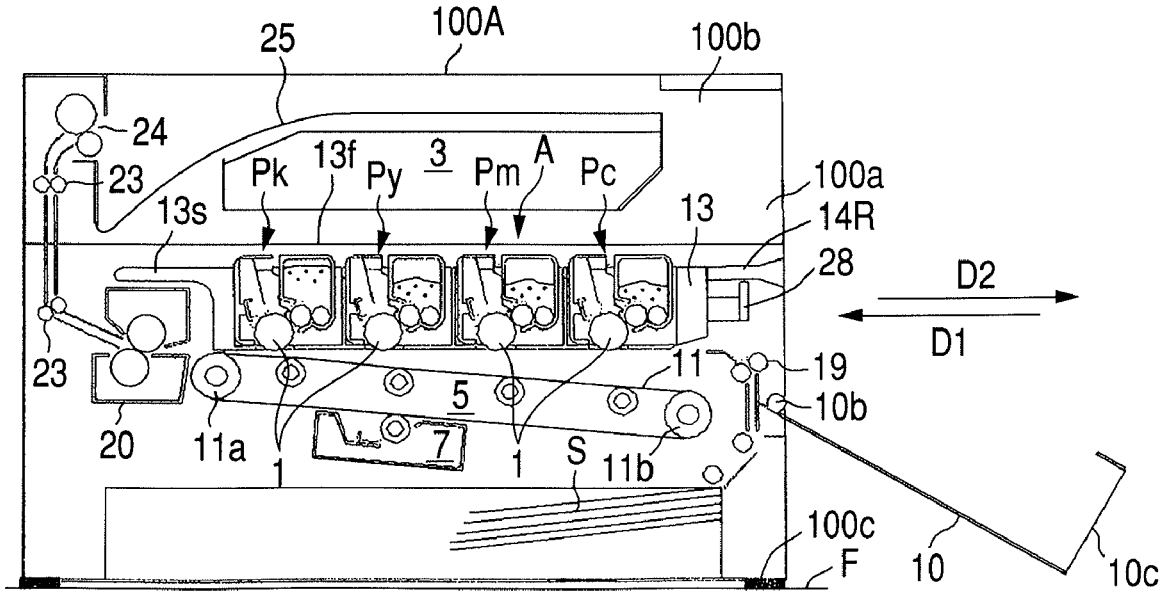
FIG. 5 is a schematic vertical sectional right side view of the image forming apparatus in the door opening state.

In the front side of the apparatus main body 100A, a front opening portion (first opening portion) 100*a* is provided. The opening portion 100*a* is an opening portion through which the cartridges are pushed into the inside of the apparatus main body 100A, or, when the cartridge is pulled out from the apparatus main body 100A, the pullout member (cartridge supporting member) 13 supporting the cartridge passes. Note that, the pullout member 13 is made of a metal. Besides, an upper opening portion (a second opening portion) 100*b* is provided on the front upper portion of the apparatus main body 100A with the upper opening portion continuing the front opening portion 100*a*. On the front side of the apparatus main body 100A, a rotatable door 10 is arranged. The door 10 is an opening and closing member capable of assuming a closing position for closing the opening portion 100*a* and of assuming an open position for opening the opening portion 100*a*. In this embodiment, the door (opening and closing member) 10 is rotatable for opening and closing with respect to the apparatus main body 100A about a hinge portion 10*b* positioned at a lower side of the door. Specifically, the door 10 rotates about the hinge portion 10*b* as a center so as to be raised, whereby the opening portion 100*a* is closed as illustrated in FIG. 1 and FIG. 2. Further, the door 10 rotates about the hinge portion 10*b* as the center so as to be tilted down toward the front of the apparatus main body 100A, whereby the opening portion 100*a* is open as illustrated in FIG. 4 and FIG. 5. Reference symbol 10*a* denotes a finger engageable portion formed in the front of the door 10. The top of the door 10 is folded inwardly at a substantially right angle as a top door portion 10*c* with respect to the opening portion 10*b*. If the door 10 moves to the closing position with respect to the opening portion 100*a*, the top door portion 10*c* also assumes a closing position with respect to the opening portion 10*b*, whereby the opening portion 100*b* is closed by the top door portion 10*c*. Besides, if the door 10 moves to the opening position for opening the opening portion 10*a*, the top door portion 10*c* also moves to the opening position for opening the opening portion 10*b*. With this operation, the opening portion 100*b* is opened.

Specifically, the pullout member (cartridge supporting member) 13 moves, while detachably supporting the plurality of cartridges P, between an inside position A positioned inside the apparatus main body 100A and a pullout position B pulled out to the outside of the apparatus main body 100A from the inside position A.

The pullout member 13 moves, under a state as illustrated in FIG. 4 and FIG. 5 in which the door 10 is opened, through the opening portion 100*a* in a front-rear direction with respect to the apparatus main body 100A by being guided by a guide means described later. Specifically, the pullout member 13 is provided so as to be movable, with respect to the apparatus main body 100A, in a direction indicated by the arrow D1 (push-in direction: rear direction) which is a substantially horizontal direction and in a direction indicated by the arrow D2 (pullout direction: front direction) which is reverse thereto. Then, the respective cartridges P are arranged in such a manner that the longitudinal directions thereof (axis direction of drum 1, axis direction of development roller 40) are adjacent to each other in the movement directions of the pullout member 13 (the same direction as the arrows D1 and D2), and are supported by the pullout member 13. Specifically, the pullout member 13 supports the plurality of cartridges P (Pk, Py, Pm, Pc) in a state being arranged adjacently in one direction. As described above, the pullout member 13 supports the plurality of cartridges P (Pk, Py, Pm, Pc) in a state in which the longitudinal direction thereof are arranged in a (substantially orthogonal) direction orthogonal to the direction indicated by the arrow D1 (D2 direction). Then, the pullout member 13 is movable, under a state in which the door 10 is opened, between the inside position A for positioning the cartridges P inside the apparatus main body 100A and the pullout position (outside position) B pulled out from the inside position A, at which the respective cartridges are detachable. The inside position A is, for example, in a state illustrated in FIG. 2 and FIG. 3. The pullout position B is, for example, in a state illustrated in FIG. 6, FIG. 7, and FIG. 8. According to this embodiment, in a state in which the pullout member 13 is positioned at the inside position A, the cartridges P perform the image formation. In a state in which the pullout member 13 is positioned at the pullout position B pulled out from the apparatus main body 100A, the cartridges P are detachable with respect to the pullout member 13.

Figure 9A:
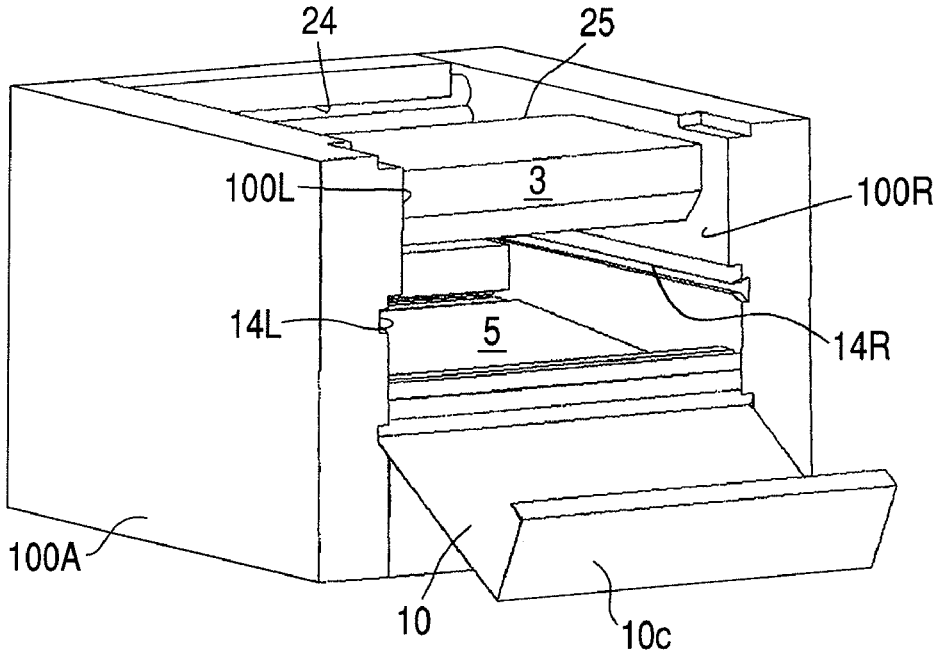
FIGS. 9A and 9B are explanatory diagrams illustrating a pullout member mounting portion in an apparatus main body.
Figure 9B:
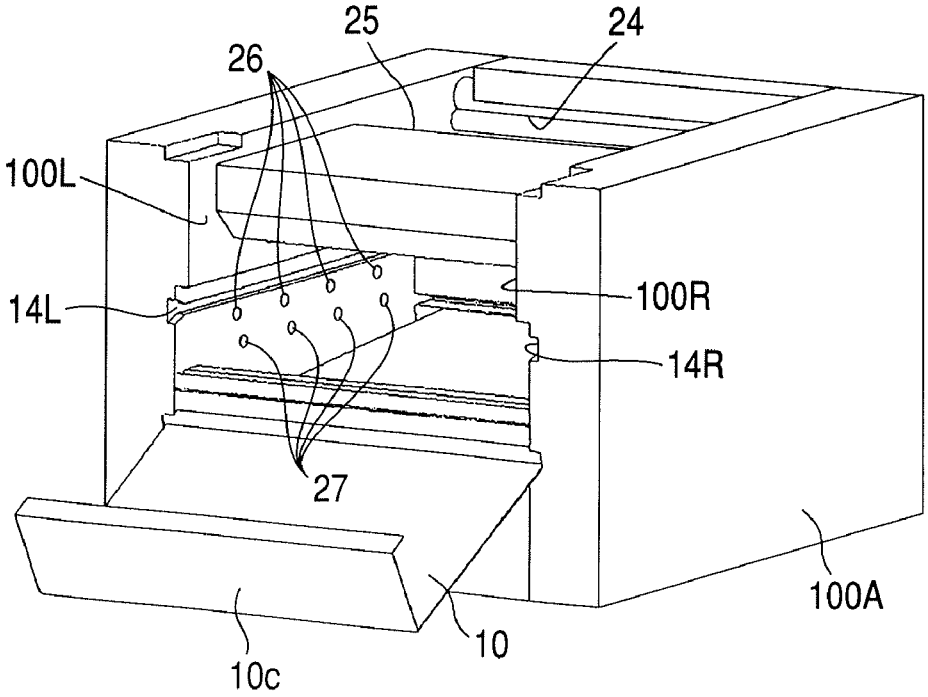
Figure 12:
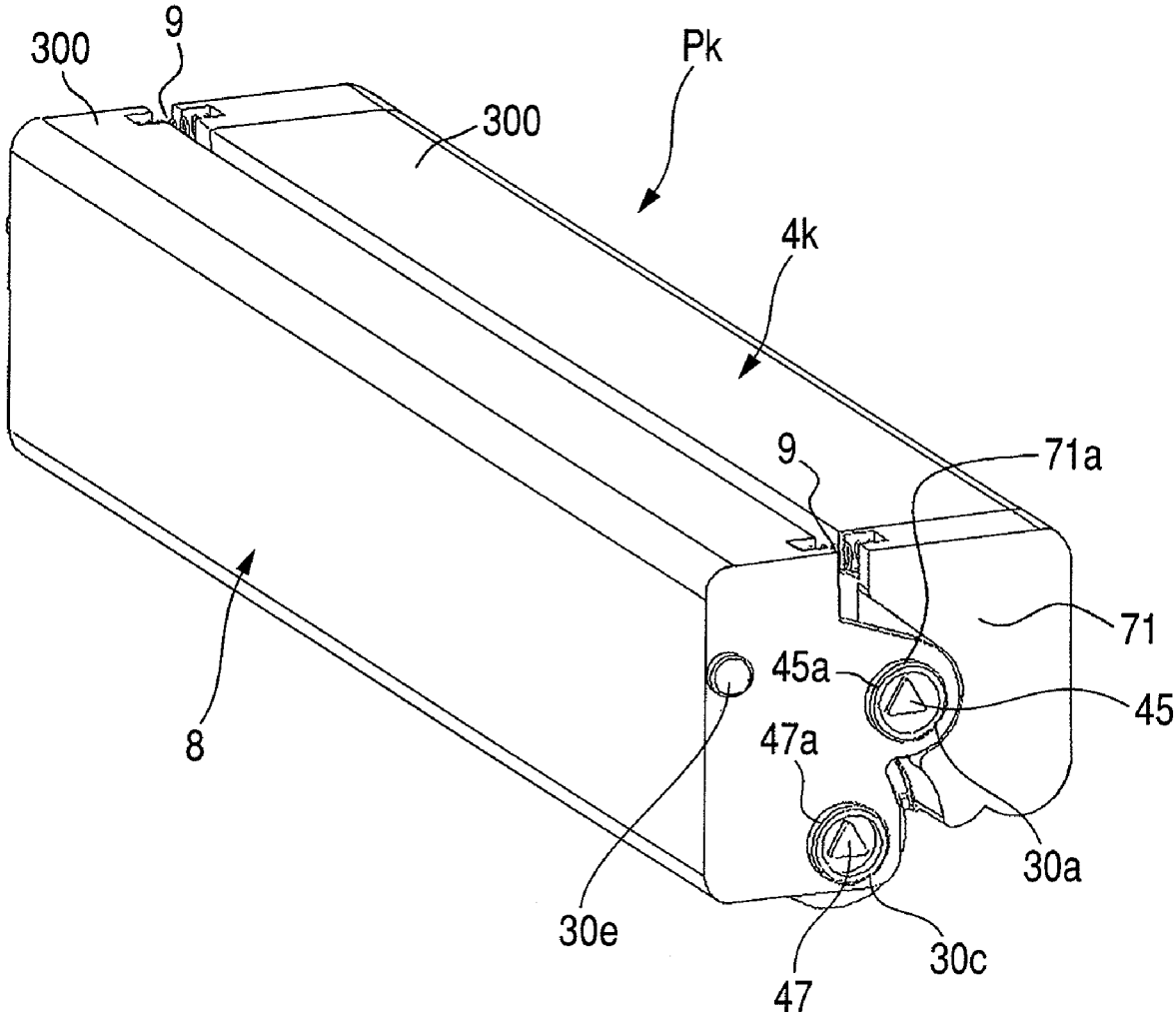
FIG. 12 is an external perspective view of the black cartridge viewed from a drive side.

In a state in which the door 10 is closed (FIG. 1 and FIG. 2), the pullout member 13 is positioned at the inside position A for positioning the cartridges P inside the apparatus main body 100A. The inside position A is a position in which the pullout member 13 is positioned inside the apparatus main body 100A than the opening portion 100*a*. According to this embodiment, the inside position A is a position in which the pullout member 13 supports the respective cartridges P, and is a latent image forming position (image forming position) in which the electrostatic latent image may be formed on the drum 1 inside the apparatus main body 100A. Specifically, the respective cartridges P are positioned at their mounting positions with respect to the apparatus main body 100A. Then, the respective drums 1 are brought into contact with the belt 11, thereby being in a state in which the developer image may be transferred from the drums 1 onto the recording medium S which is conveyed with the belt 11. At the inside position A, the respective cartridges P are pressed by pressing members to be fixed to predetermined positioning portions (not shown) In this state, with respect to drive input portions (coupling members 45 and 47: FIG. 12) of the respective cartridges, drive output portions (drum coupling members 27 and developer coupling members 26: FIG. 9B) provided to the apparatus main body 100A are coupled. With respect to electrical contacts (not shown) of the respective cartridges, a power feeding system (not shown) on the apparatus main body side is connected. The pullout member 13 is positioned and fixed to the apparatus main body 100A with fixing means (not shown). In this state, the image forming apparatus 100 is allowed to carry out image forming operation.

If the door 10 is opened as illustrated in FIG. 4 and FIG. 5, the opening portion 100*a* and the opening portion 100*b* of the apparatus main body 100A are opened. Then, at the opening portion 100*a*, a handle portion 28, which is provided to a front surface of a front frame of the pullout member 13, is exposed. Further, with an interlocking mechanism (not shown), which interlocks with the opening and rotational movement of the door 10, a second roller 11*b* side of the belt unit 5 moves down to a predetermined position about a rotation center axis of a first roller 11*a* as a center. With this operation, the belt 11 is separated from the lower surface of the drum 1 of the respective cartridges P. Specifically, the contact of the belt 11 with respect to the drum 1 is released. Further, the coupling of the drive output portion on the apparatus main body side with respect to the drive input portion of the respective cartridges P is released (drive release). Further, the pressing of the pressing member, with which the respective cartridges P is positioned and fixed, is released (pressing release). Further, the conduction of the power feeding system on the apparatus main body side with respect to the electrical contacts of the respective cartridges P is released (power feeding release). Still further, the positioning and fixing of the pullout member 13 with respect to the apparatus main body 100A by a positioning and fixing means is released.

As described above, to the apparatus main body 100A, the opening portion (first opening portion) 100*a* for allowing the pullout member 13 to pass through is provided. Further, in a state in which the pullout member 13 is positioned at the pullout position B, the opening portion (second opening portion) 100*b* is provided so as to position above the heaviest cartridge Pk positioned in the apparatus main body 100A. Provision of the opening portion 100*b* allows the attachment and detachment of the cartridge Pk positioned in the apparatus main body 100A with respect to the pullout member 13 to be carried more easier. Note that, if an opening area of the opening portion 100*a* is large, the attachment and detachment of the cartridge Pk with respect to the pullout member 13 may be carried out without the opening portion 100*b*. However, provision of the opening portion 100*b* allows the attachment and detachment of the cartridge Pk with respect to the pullout member 13 to be carried out further easier. The opening portions 100*a* and 100*b* are opened and closed using a common door (opening and closing member) 10.

Figure 6:
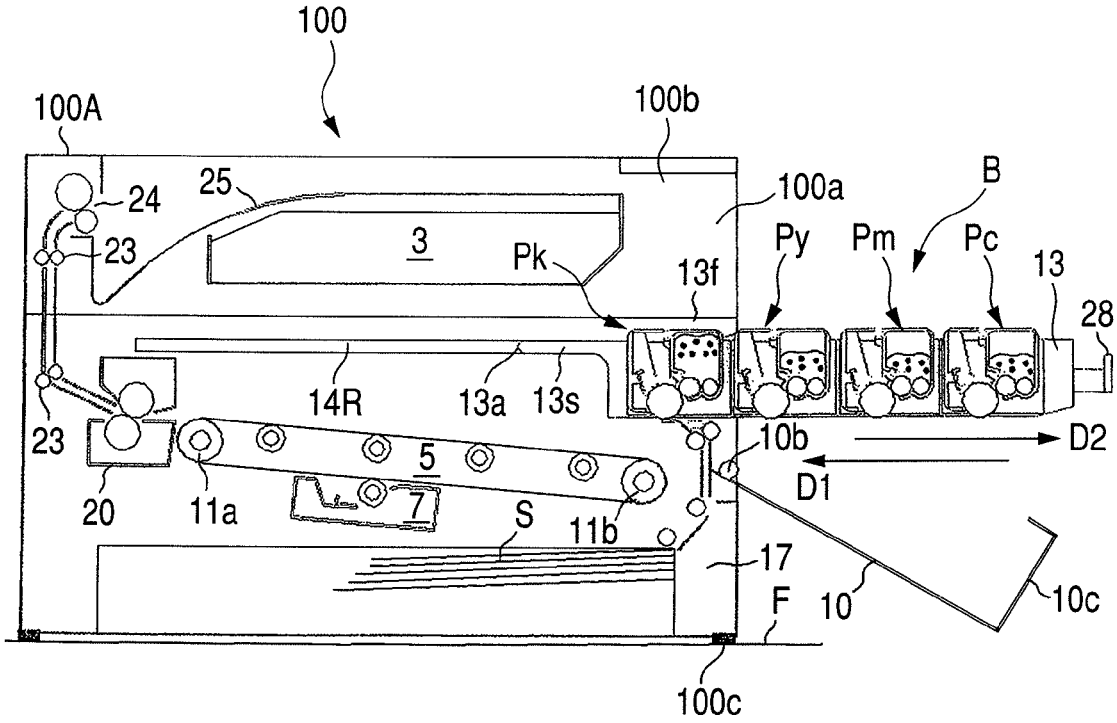
FIG. 6 is a schematic vertical sectional right side view of the image forming apparatus in a state in which a pullout member is pulled out to a pullout position.
Figure 7:
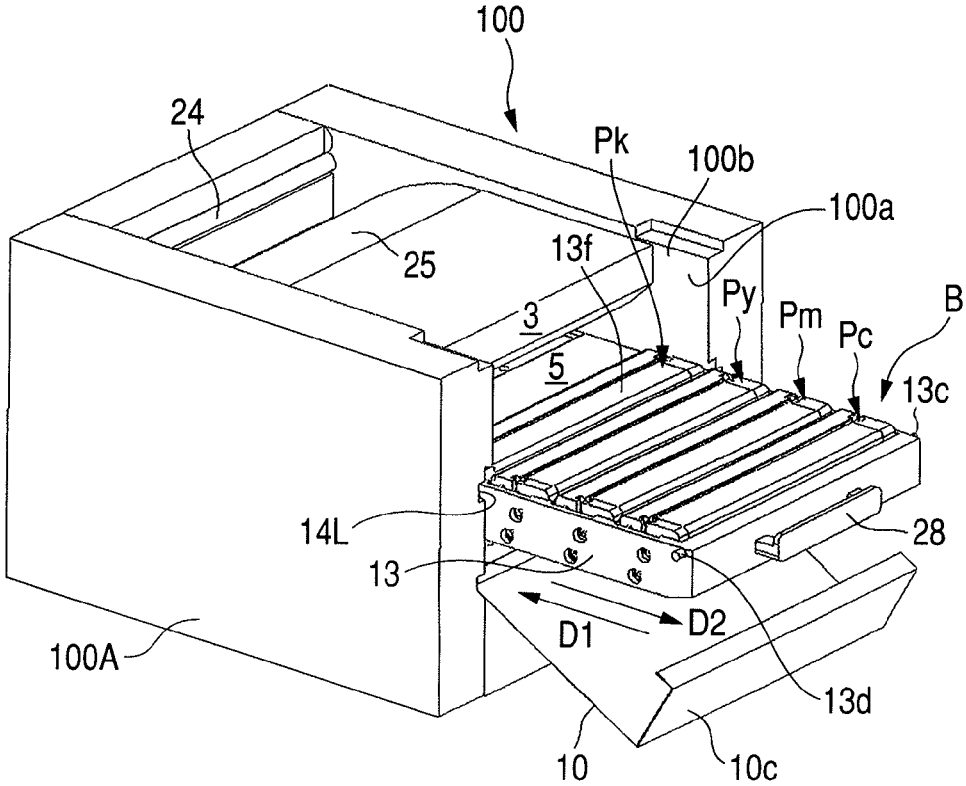
FIG. 7 is an external perspective view of the image forming apparatus in a state in which the pullout member is pulled out to the pullout position.
Figure 8:
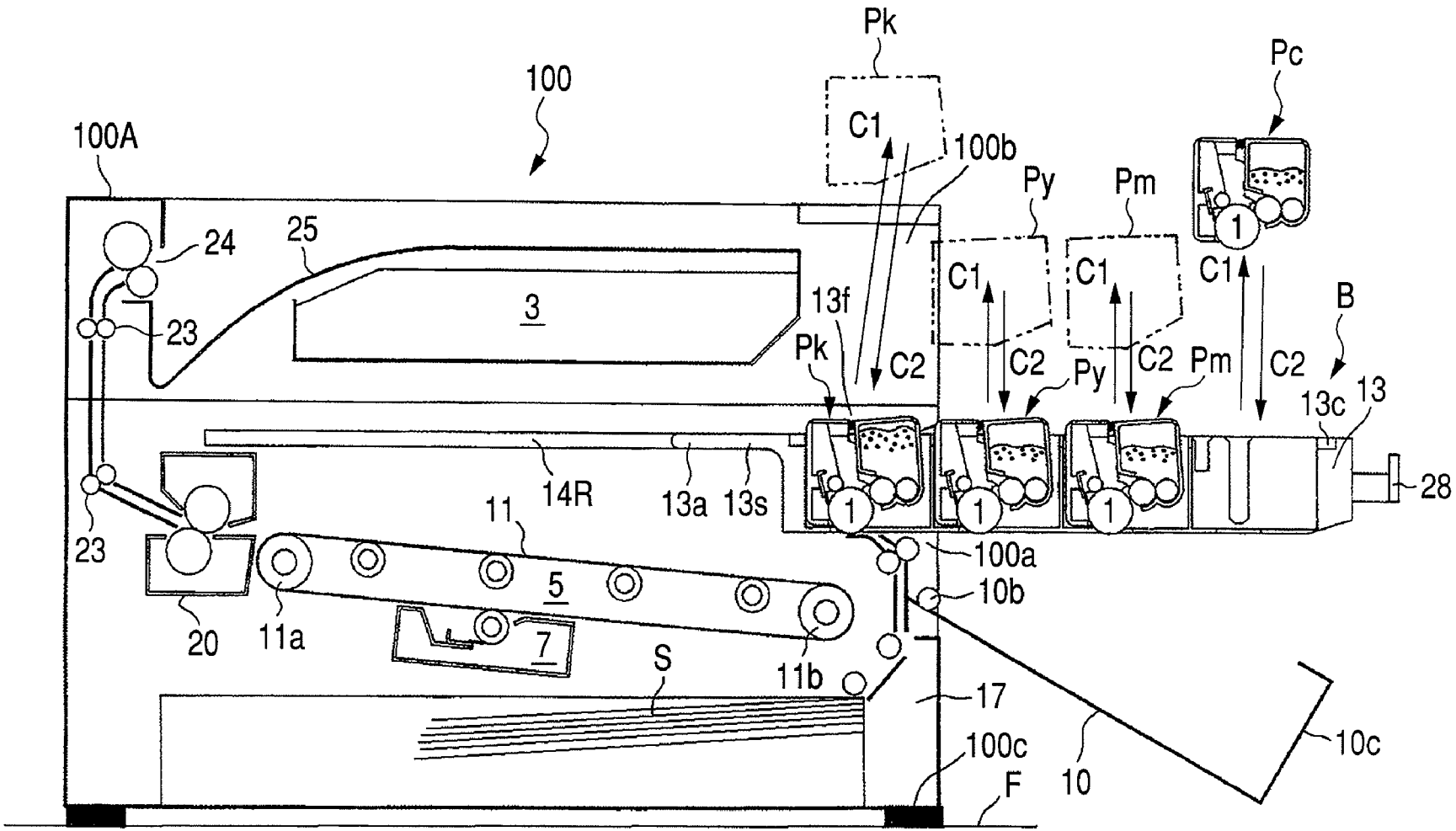
FIG. 8 is an explanatory diagram for illustrating a replacement procedure of the cartridges.

Then, the user grasps the handle portion 28 and slide-moves the pullout member 13 horizontally in a front direction, which being the pullout direction D2, with respect to the apparatus main body 100A. Then, the pullout member 13 is pulled out sufficiently from the opening portion 100*a* to a predetermined pullout position B outside the apparatus main body 100A (FIG. 6 and FIG. 7). Specifically, the pullout member 13 is sufficiently pulled out to the predetermined position B, which is a position projected as much as possible from the inside to the outside of the apparatus main body 100A. If the pullout member 13 is sufficiently pulled out to the predetermined pullout position B, the further pullout movement is blocked with a stopper member (not shown). During the pullout movement of the pullout member 13, the drums 1 of the respective cartridges P and the belt 11 are separated. Thus, rubbing between the both does not cause.

In this embodiment, in the pullout direction D2 from the inside position A toward the pullout position B, the cartridge Pk positioned most upstream of the pullout member 13 is positioned inside the apparatus main body 100A (FIG. 6 and FIG. 7) at the pullout position B of the pullout member 13. The other cartridges Py, Pm, Pc are positioned outside the apparatus main body 100A. Then, the pullout member 13 has a structure in which the individual cartridges P (Pk, Py, Pm, Pc) each may be removed upward, and may be supported by moving the respective cartridges downward. Therefore, the user lifts up a spent cartridge to be replaced from the pullout member 13 to remove the spent cartridge (upward arrow C1 of FIG. 8). Then, a new cartridge is downwardly dropped (downward arrow direction C2) with respect to the pullout member 13 from the above, which being a substantially gravity direction. With this operation, the cartridge is supported in the pullout member 13.

The cartridges Py, Pm, Pc positioned outside the apparatus main body 100A are removed by being lifted up with respect to the pullout member 13 at the outside of the apparatus main body 100A, and are mounted by being fitted therein from the above. The cartridge Pk positioned inside the apparatus main body may be removed from the pullout member 13 in a state being positioned inside the apparatus main body 100A by allowing the cartridge Pk to pass through the opening portion 100*b*, and may be mounted onto the pullout member 13 by being fitted therein from the above.

As described above, in the state in which the pullout member 13 is positioned at the pullout position B, the heaviest cartridge Pk is positioned inside the apparatus main body 100A. Then, the cartridges Py, Pm, Pc except the heaviest cartridge Pk are positioned outside the apparatus main body 100A. Specifically, in a state in which the cartridge supporting member is positioned at the pullout position, the heaviest cartridge is positioned inside the apparatus main body, and the other cartridges except the heaviest cartridge are positioned outside the apparatus main body. With this structure, such a moment that the pullout member 13 tends to tilt down due to the gravitational force may be reduced (This point is described later.).

After completion of the replacement operation of the cartridge with respect to the pullout member 13, the user horizontally slide-moves the pullout member 13 toward backward, with respect to the apparatus main body 100A, which is the push-in direction D1 being reverse to the pullout direction D2. Then, the pullout member 13 is moved from the pullout position B to the inside of the apparatus main body 100A by being sufficiently pushed-in. When the pullout member 13 is sufficiently pushed-in inside the apparatus main body 100A, the further push-in movement is blocked with the stopper member (not shown) (FIG. 4 and FIG. 5). During the push-in movement of the pullout member 13, the drum 1 of the respective cartridges P and the belt 11 are separated, whereby the rubbing between the both does not cause.

If the pullout member 13 is sufficiently pushed-in inside the apparatus main body 100A, the door 10 is closed (FIG. 1 and FIG. 2). With the closing operation of the door 10, the opening portion 100*a* and the opening portion 100*b* of the apparatus main body 100A are closed. Further, with an interlocking mechanism which interlocks with the closing operation of the door (opening and closing member) 10, the pullout member 13 moves down and is positioned and fixed with respect to the apparatus main body 100A by a position fixing means. Besides, the respective cartridges P are pushed by the pressing member (not shown) and are come to a state being positioned and fixed to predetermined positioning portions. Further, the drive output portion on the apparatus main body side is coupled with respect to the drive input portion of the respective cartridges P. Further, the conduction of the power feeding system on the apparatus main body side with respect to the electrical contacts of the respective cartridges P is established. Then, the second roller 11*b* side of the belt unit 5 moves up to a predetermined position about the rotation center axis of the first roller 11*a* as a center. With this operation, the belt 11 becomes a contact state with respect to the lower surface of the drums 1 of the respective cartridges P. According to this embodiment, in this state, the image forming apparatus 100 is allowed to carry out image forming operation. Specifically, the pullout member 13 is positioned at the inside position A. The inside position A is a position in which the pullout member 13 is positioned inside the apparatus main body 100A than the opening portion 100*a*.

As described above, the plurality of cartridges P enters inside the apparatus main body 100 together with the pullout member 13 while being supported by the pullout member 13. Accordingly, the user allows the pullout member 13 to enter the inside of the apparatus main body 100A, and closes the door 10. With this operation, the plurality of cartridges P may be positively mounted with respect to the apparatus main body 100A. Therefore, compared to a structure of individually mounting the respective cartridges P within the apparatus main body 100A, the mounting and detaching operability may be enhanced.

As described above, the pullout member (cartridge supporting member) 13 moves, while detachably supporting the plurality of cartridges P, between the inside position A positioned inside the apparatus main body 100A and the pullout position B pulled out from the inside position A to the outside of the apparatus main body 100A. Then, the pullout member 13 supports the plurality of the cartridges P by arranging them in the pullout member 13 so that the longitudinal directions of the cartridges P is orthogonal to the pullout direction D2 in which the pullout member 13 is moved from the inside position A to the pullout position B. Also, the pullout member 13 is configured so as to support the heaviest cartridge most upstream of the pullout direction D2. Note that, in the above-mentioned embodiment, the heaviest cartridge P is the black cartridge Pk.

The same is true in each of embodiments described below.

(Pullout Member Mounting Portion of Apparatus Main Body)

Pullout member mounting portions provided to the apparatus main body 100A are described with reference to FIG. 9A and FIG. 9B. Inside a right side wall 100R and inside a left side wall 100L of a main frame constituting a skeletal structure of the apparatus main body 100A, guide groove portions 14R and 14L are provided while opposing to each other. The guide groove portions 14R and 14L are provided substantially horizontally in front-rear direction, and a cross section, which is orthogonal to the substantially horizontal direction, has a rectangle shape (a shape of a square bracket). The guide groove portions 14R and 14L extend from the opening portion 100*a* toward a deep side of the apparatus main body 100A. With respect to the right and left guide groove portions 14R and 14L, the guided portion of the pullout member 13, which is described later, is engaged. With this structure, the pullout member 13 is mounted with respect to the apparatus main body 100A with the above-mentioned guide groove portions 14R and 14L and the guided portion being as guide means, so as to move in the direction indicated by the arrow D1 (push-in direction) which is a substantially horizontal direction, and in the direction indicated by the arrow D2 (pullout direction) which is reverse thereto. Note that, the above-mentioned "substantially horizontal" means substantially horizontal with respect to an installation surface F of the image forming apparatus 100. Note that, the pullout member 13 is not limited to the horizontal linear movement with respect to the above-mentioned installation surface F, but may be configured, for example, to move linearly obliquely above or obliquely below with respect to the above-mentioned installation surface F.

In this embodiment, the left side wall 100L side of the main frame is a driving force transmitting side from the apparatus main body 100A to the cartridges P. Then, as illustrated in FIG. 9B, below the guide groove portion 14L inside the left side wall, as the drive output portion on the apparatus main body side, for transmitting driving forces to the drums 1 of the respective cartridges P, the four drum coupling members 27 are arranged at the same intervals in the horizontal direction. Further, as the drive output portion on the apparatus main body side, for transmitting the drive force to the development rollers 40 of the respective cartridges P, the four developer coupling members 26 are arranged at given intervals in a horizontal direction.

The above-mentioned drum coupling members 27 and the developer coupling members 26 transmit the driving forces from the driving source (not shown) to the cartridges P. The drum coupling members 27 and the developer coupling members 26 are in retreated states within the left side wall in the state in which the door 10 is open, and enter the cartridge P side in association with the door 10 closing operation.

(Pullout Member)

Figure 10A:
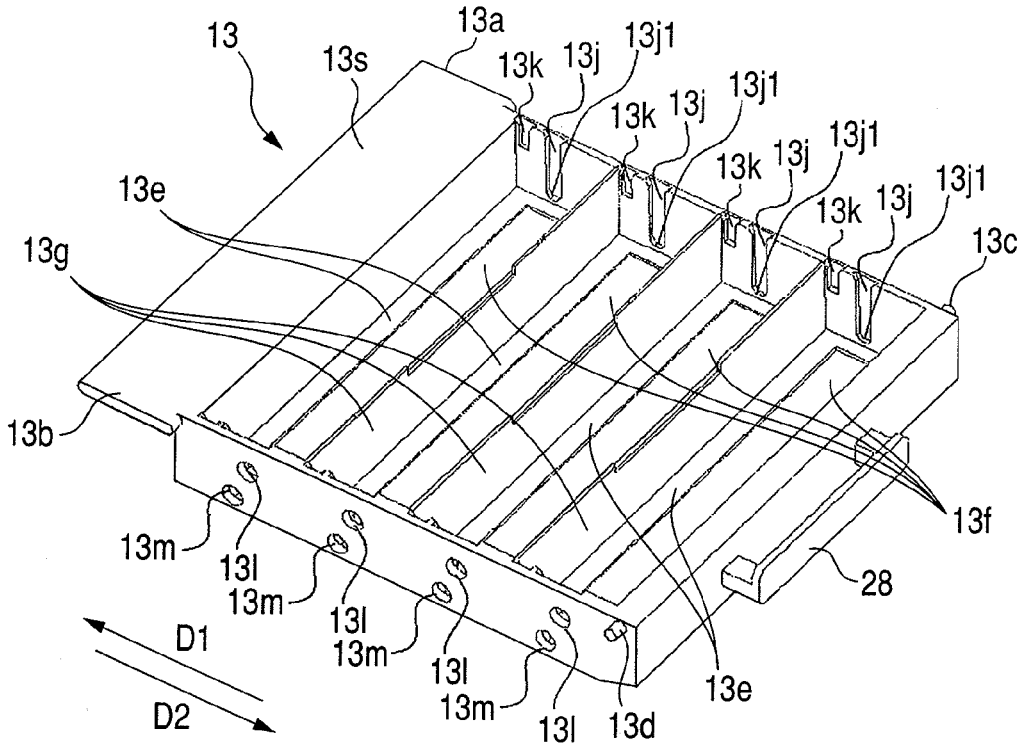
Figure 10B:
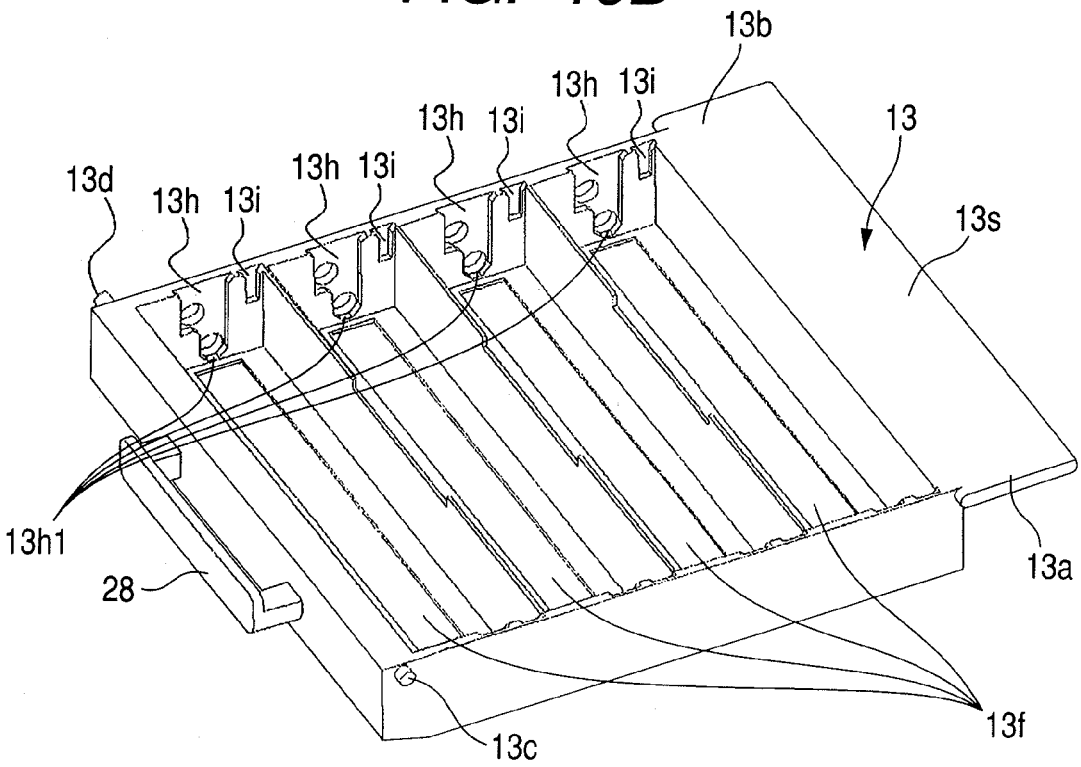

The pullout member (cartridge supporting member, pullout unit) 13 is described in detail with reference to FIG. 10A and FIG. 10B. FIG. 10A is a perspective view of the pullout member 13, and the driving side (left side) thereof is viewed obliquely from the above, and FIG. 10B is a perspective view of the pullout member 13, and the non-driving side (right side) is viewed obliquely from the above.

The pullout member 13 is a frame type member, and at the four corner portions thereof, the guided portions 13*a* to 13*d*, which are guided by being engaged with the guide groove members 14R and 14L at the right and left of the apparatus main body 100A, are provided. A guided portion (first guided portion) 13*a* and a guided portion (third guided portion) 13*c* are guided by being engaged with the right side guide groove portion (first main body side support member) 14R. Besides, the guided portion (second guided portion) 13*b* and the guided portion (fourth guided portion) 13*d* are guided by being engaged with the left side guide groove portion (second main body side support member) 14L. The guide groove portions 14R and 14L are provided to the apparatus main body 100A so as to oppose to each other.

The guided portions 13*a* (first guided portion) and 13*b* (second guided portion), which are provided upstream side in the pullout direction D2, have a shape extending in the pullout direction so that the pullout member 13 does not tilt with respect to the apparatus main body 100A at the pullout position B. In addition, the guided portions 13*a* and 13*b* each have a shape projecting outwardly in a direction in which the guide groove portions 14R and 14L are provided so as to be guided by being engaged with the right side and the left side guide members 14R and 14L. As illustrated in FIG. 10A and FIG. 10B, the guided portion 13*a* and 13*b* are one end and the other end of the longitudinal direction of a guided member 13*s*, respectively. The guided member 13*s* is formed in a width direction for an overall width of the pullout member 13 (a direction orthogonal to the pullout direction D2), and is further projected from a mounting potion (support portion) 13*f*, which is positioned most upstream with respect to the pullout direction D2.

As described above, this embodiment includes the guide groove portion (first main body side support member) 14R and the guide portion (second main body side support member) 14L, which are provided to the apparatus main body 100A so as to oppose to each other, for movably supporting the pullout member 13. Further, the pullout member 13 includes the guided member 13*s*, which is provided most upstream of the pullout direction D2, and projecting from the entire width in the direction orthogonal to the pullout direction D2 and toward the upstream side in the pullout direction D2. Then, in the direction orthogonal to the pullout direction D2, the pullout member 13 includes the guided portion (first guided portion) 13*a* on one end side of the guided member 13*s*, and the guided portion (second guided portion) 13*b* on the other end side. Then, the guide groove 14R movably supports the pullout member 13 while supporting the guided portion 13*a*, and further, the guide groove portion 14L movably supports the pullout member 13 while supporting the guided portion 13*b*. Further, the guided portions 13*a* and 13*b* are provided on one end and the other end of the guided member 13*s*, respectively, as a unit. Therefore, strength (rigidity) of the guided portions 13*a* and 13*b* may be enhanced. Further, in addition to this, the guided member 13*s* is a flat plate having a substantially rectangle shape when being viewed from the above and is made of a metal, and the guided portions 13*a* and 13*b* each are provided on one end and the other end, respectively, in the longitudinal direction of the guided member 13*s*. Therefore, the guided portions 13*a* and 13*b* each extends along the pullout direction D2. With this structure, the guided portions 13*a* and 13*b* are supported positively with the guide groove portions 14R and 14L and so as to enhance the strength (rigidity). Note that, materials and the shape of the guided member 13*s* are not particularly limited to the ones described above, but with the above-mentioned material and shape, it is possible to obtain the above-mentioned effects more preferably.

Note that, in this embodiment, a cartridge support portion 13*f*, which is positioned most upstream, is a portion for supporting the cartridge Pk which is heaviest compared to the other cartridges. By configuring the guided portions 13*a* and 13*b* like this, the strength (rigidity) of the guided portions 13*a* and 13*b* may be enhanced. In addition, the strength (rigidity) of the cartridge mounting (support) portion 13*f* for mounting the cartridge Pk may be enhanced. Accordingly, downward tilting of the pullout member 13 positioned at the pullout position B may be reduced.

Further, the guided portion 13*c* (third guided portion) and 13*d* (fourth guided portion) are a circular column shape (projecting portions), and are similarly in a shape of projecting outwardly in a horizontal direction and in a direction orthogonal to the pullout direction D2.

As described above, the pullout member 13 includes, at one end side thereof, at the downstream side of the pullout direction D2, and the orthogonal direction to the pullout direction D2, the guided portion (third guided portion) 13*c* projecting toward the orthogonal direction. Further, the pullout member 13 includes, at the other end side thereof, the guided portion (fourth guided portion) 13*d* projecting toward the orthogonal direction. Then, the guide groove 14R movably supports the pullout member 13, while supporting the guided portion 13*c*, or, the guide groove portion 14L movable supports the pullout member 13, while supporting the guided portion 13*d*.

Accordingly, in this embodiment, the guided portions 13*a* and 13*b* (first guided portion and second guided portion) upstream side of the pullout direction D2, which require the strength (rigidity) is constructed into the guided portion 13*s* having a structure described above. Then, contrary to this, the guided portions 13*c* and 13*d* (third guided portion and fourth guided portion) downstream side of the pullout direction D2, which does not require the strength (rigidity), is formed into the circular columnar shape (projecting portion). With this structure, cost reduction thereof may be attained.

Further, at the front surface of the front frame of the pullout member 13, there is provided a handle portion 28 for manipulating the pullout member 13 by the user.

To the pullout member 13, the four mounting portions 13*f* for mounting the cartridges P described later, are provided in a line in the front-rear direction. Between the respective mounting portions 13*f*, there are provided partitioning plates 13*g* serving as guides (marks) for mounting the cartridges P. Below the respective mounting portions 13*f*, opening portions 13*e* are provided. Through the opening portion 13*e*, the drums 1 provided to the cartridges P are brought into contact with the belt 11.

At the drive side ends of the respective mounting portions 13*f*, guide portions 13*h* and 13*i* for mounting the cartridges P into the pullout member 13. Similarly, at the non-drive side ends of the respective mounting portions 13*f*, too, guide portions 13*j* and 13*k* for mounting the cartridges P into the pullout member 13.

Below the guide portions 13*h* and 13*j*, there are provided positioning portions 13*h*1 and 13*j*1 for positioning the cartridges P with respect to the pullout member 13.

Further, on the drive side of the pullout member 13, there are provided opening portions 131 for allowing the above-mentioned drum coupling members 27 to enter, and opening portions 13*m* for allowing the developer coupling members 26 to enter. The coupling members 27 and 26 each enter the opening portions 13*m* and the opening portions 131 in association with an operation for closing the door 10. After that, the coupling members 27 and 26 are engaged with the coupling members of the cartridges P described later, to thereby transmit the driving forces to the cartridges P.

As described above, the pullout member 13 moves inside the apparatus main body 100A by moving the pullout member 13 in the direction indicated by the arrow D1 while engaging the guided portions 13*a* to 13*d* provided to the pullout member 13 with the guide groove portions 14R and 14L. The pullout member 13 is movable in the same direction as the above-mentioned one direction (along the directions indicated by the arrows D1 and D2) in which the cartridges P are arranged. Specifically, the pullout member 13 is movable in a direction orthogonal to the longitudinal direction of the cartridges P, which are supported by the pullout member 13.

(Cartridge)

Figure 11:
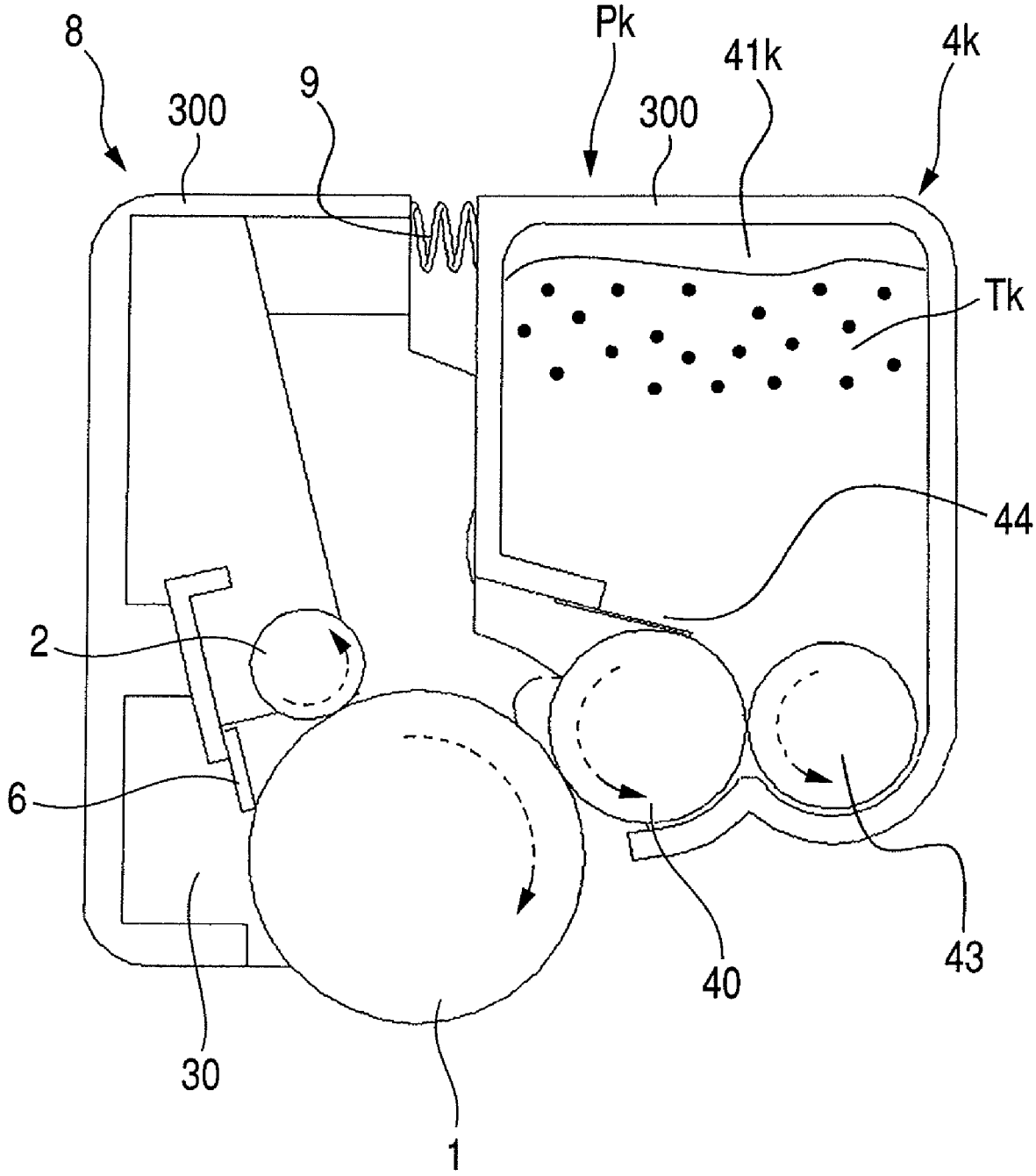
FIG. 11 is a schematic enlarged lateral sectional view of a black cartridge.
Figure 13:
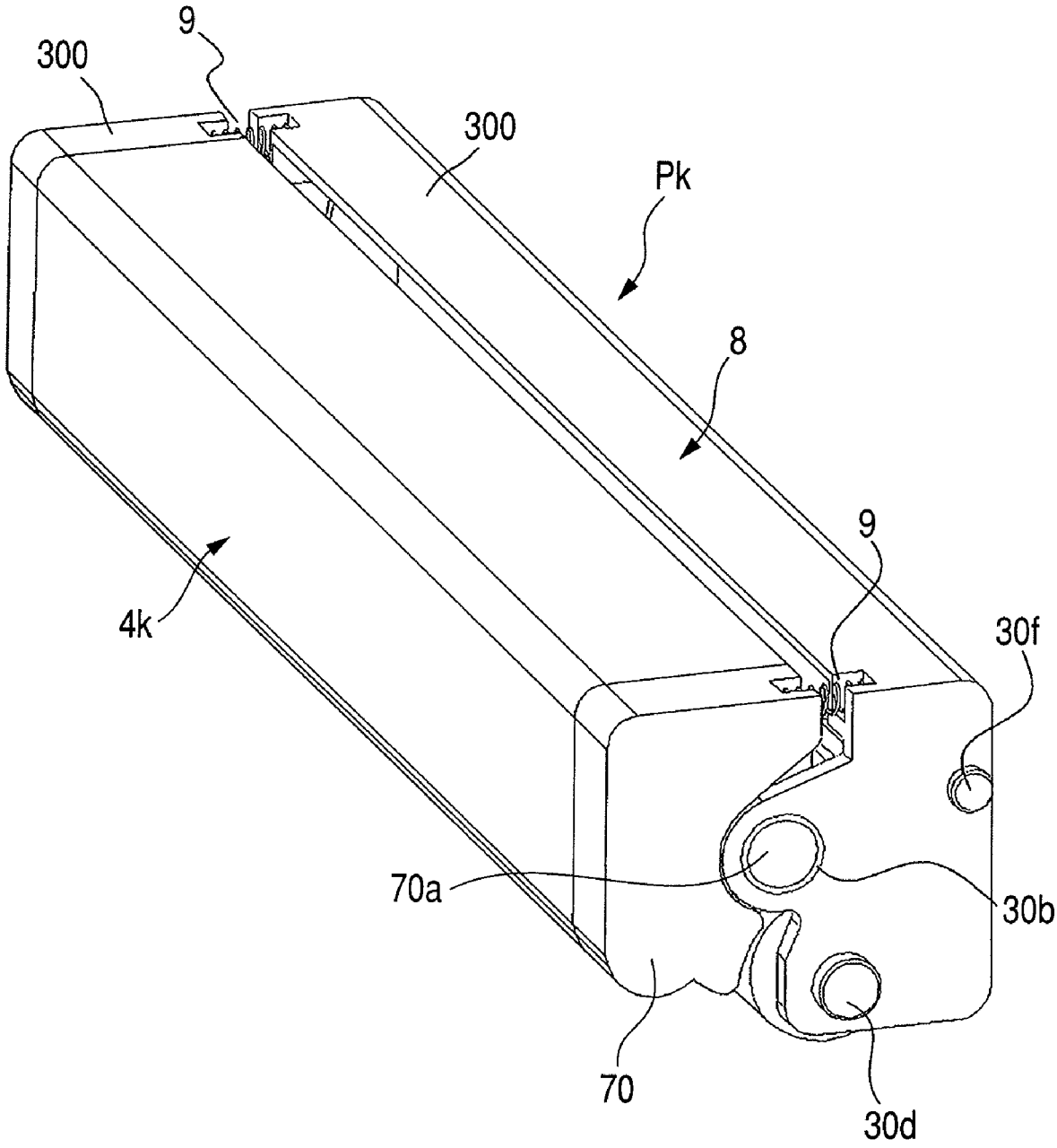
FIG. 13 is an external perspective view of the black cartridge viewed from a non-drive side.

With regard to the cartridges to be mounted (supported) on the pullout member 13, a description will be provided with reference to FIGS. 11 to 13. FIG. 11 is an enlarged cross-sectional view of the cartridge P, and the description will be provided while taking as a representative a black cartridge Pk as an example. With regard to the other color cartridges Py, Pm, and Pc, the structures thereof are the same, except that the amounts and colors of the contained developers are different with each other. FIG. 12 is a perspective view of the drive side of the cartridge Pk, which is viewed obliquely from the above. FIG. 13 is a perspective view of the non-drive side of the cartridge Pk, which is viewed obliquely from the above.

The cartridge Pk is constructed by integrating the photosensitive unit 8 and the developing unit 4*k*. The photosensitive unit 8 includes the drum 1, the charging roller 2, the cleaning means 6, and a removed developer containing portion 30 removed by the cleaning means 6. Besides, the developing unit 4*k* includes a development roller 40, a developer supply roller 43, a developing blade 44, and a developer containing portion 1*k* for containing the developer Tk to be used for image formation.

The drum 1, the development roller 40, and the developer supply roller 43 are rotatingly driven in directions indicated by the dotted arrows, respectively. The charging roller 2 is rotated in association with the rotation of the drum 1. To the charging roller 2, a predetermined charging bias is applied. A predetermined developing bias is applied to the development roller 40.

The developer Tk within the developer containing portion 41*k* is fed into the developer supply roller 43. Then, with the developing blade 44, which is brought into pressure contact with an outer periphery of the developer supply roller 43 and the development roller 40, the developer Tk is applied to the outer periphery of the development roller 40. Also, to the developer Tk, an electric field having a predetermined polarity is applied by the developing blade 44. Then, from the apparatus main body 100A side, a predetermined developing bias is applied to the development roller 40. With this operation, an electrostatic latent image formed on the drum 1 is developed as the developer image. The developer image formed on the drum 1 is transferred onto the recording medium S, and thereafter, the developer remaining on the drum surface is removed with the cleaning means 6 to be received within the removed developer containing portion 30.

If the developer Tk within the developer containing portion 41*k* is consumed, the operator replaces the cartridge Pk with new one. With this operation, the image formation may be carried out again.

At the drive side end of the cartridge Pk, the coupling member 47 for receiving a driving force from the drum coupling members 27 on the apparatus main body side, is rotatably provided. Besides, the coupling member 45 for receiving a driving force from the developer coupling members 26, is rotatably provided.

The coupling member 47 is provided on the drive side end of the drum 1. Then, the driving force received by the coupling member 47 from the apparatus main body 100A rotates the drum 1. Further, the driving force received by the coupling member 45 is transmitted to the development roller 40 and the developer supply roller 43 via an intermediate gear (not shown).

The coupling member 45 is surrounded by a cylindrical rib 45*a* (FIG. 12). The cylindrical rib 45*a* forms an engagement portion 71*a*. The engagement portion 71*a* is provided to a side cover 71 fixed to outside of the developer containing portion 41*k*. The coupling member 45 is rotatable with respect to the engagement portion 71*a*. Further, on an opposing side of the engagement portion 71*a*, an engagement portion 70*a* is provided. The engagement portion 70*a* is provided to the side cover 70 as well. The engagement portions 70*a* and 71*a* are provided on the developing unit 4*k* as well.

Further, to the removed developer containing portion 30, hole portions 30*a* and 30*b* for supporting the engagement portions 71*a* and 70*a* are provided. The hole portions 30*a* and 30*b* provided to the removed developer containing portion 30 are engaged with the engagement portions 70*a* and 71*a* provided on the developing unit 4*k*. With this structure, the photosensitive unit 8 and the developing unit 4 are coupled to each other. Between the photosensitive unit 8 and the developing unit 4, a spring (urging member) 9 is provided by being compressed. With this pushing force of the compressed spring 9, the photosensitive unit 8 and the developing unit 4 are urged to be rotated about the coupling portion as a center. With this structure, an abutment of the drum 1 and the development roller 40 is secured.

The coupling member 47 is surrounded with the cylindrical ribs 47*a* (FIG. 12). The ribs 47*a* form a guided portion 30*c*. Further, on an opposing side of the longitudinal direction thereof, a cylindrical protrusion is projected to form a guided portion 30*d*. Further, above the guided portion 30*c*, a guided portion 30*e* is provided. Similarly, above the guided portion 30*d*, a guided portion 30*f* is provided. The respective guided portions 30*c*, 30*d*, 30*e*, 30*f* have functions of mounting the cartridge Pk into the pullout member 13, and of positioning the cartridge Pk within the pullout member 13.

In this case, the photosensitive unit 8 may have a structure of containing at least the drum 1. In addition, the photosensitive unit 8 may employ a structure of containing at least one of the charging roller 2, the drum cleaning means 6, and the removed developer containing portion 30 for receiving the developer removed by the drum cleaning means 6, and the drum 1.

(Cartridge Mounting (Supporting) of Pullout Member)

Figure 14:
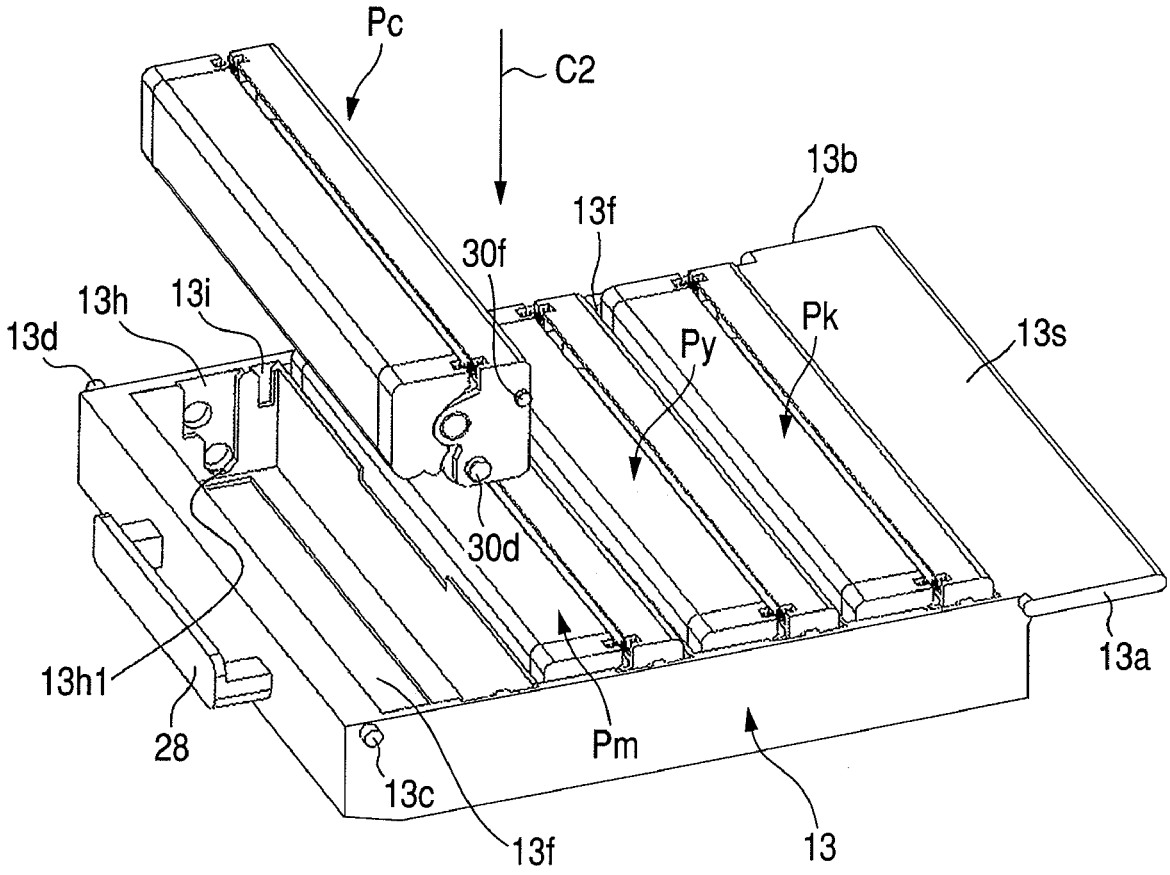
FIG. 14 is a diagram for illustrating a state in which a cartridge P is mounted to the pullout member, and is a perspective view of the non-drive side viewed obliquely from above.
Figure 15:
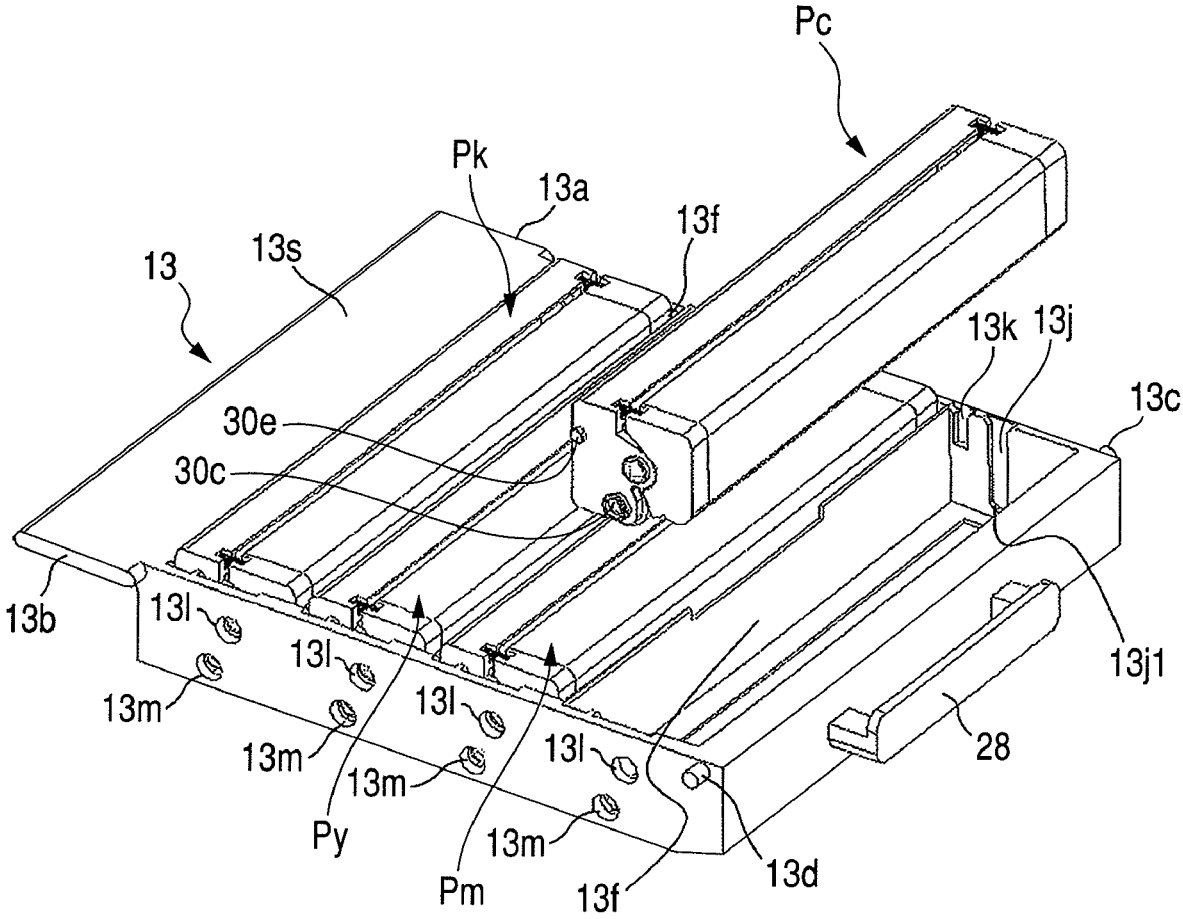
FIG. 15 is a perspective view of the drive side viewed obliquely from the above, for illustrating the state of FIG. 14
Figure 16:
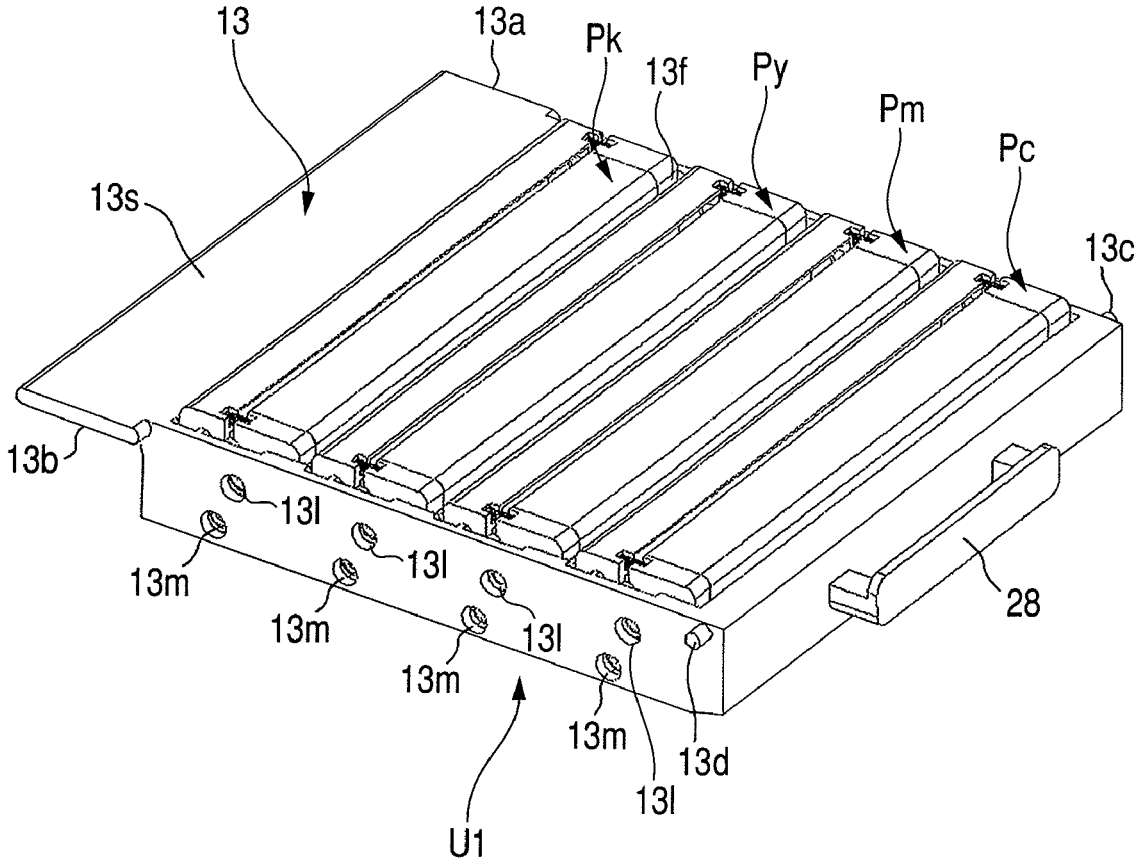
FIG. 16 is a perspective view of the drive side viewed obliquely from the above, for illustrating a state in which the mounting of all the cartridges to the pullout member is completed.
Figure 17:
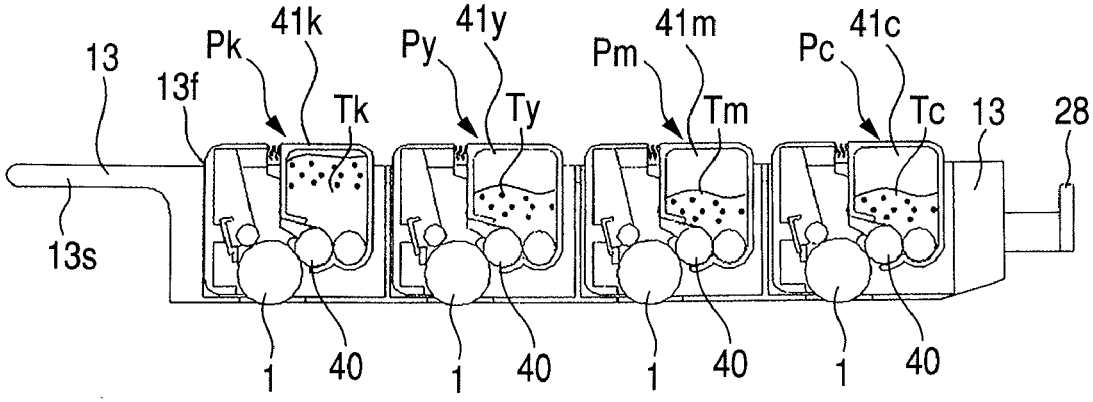
FIG. 17 is a vertical sectional right side view of the pullout member in the state of FIG. 16.

The mounting (supporting) of the respective cartridges P (Pk, Py, Pm, Pc) to the pullout member 13 is described with reference to FIGS. 14 to 17. FIG. 14 is a diagram illustrating a mounting state of the cartridges P with respect to the pullout member 13, and is a perspective view of the non-drive side viewed obliquely from the above. The apparatus main body 100A and the other components are omitted. FIG. 15 is a perspective view of the drive side viewed obliquely from the above, for illustrating a state of FIG. 14. FIG. 16 is a perspective view of the drive side viewed obliquely from the above, for illustrating a state in which the mounting of all the cartridges to the pullout member is completed. FIG. 17 is a vertical sectional right side view of the pullout member 13 in the state of FIG. 16.

The respective cartridges P are mounted to the corresponding mounting portions 13*f* provided to the pullout member 13. The user moves the cartridges P downward in a direction indicated by the arrow C2, which is a substantially gravity direction, with respect to the corresponding mounting portions 13*f* of the pullout member 13 for mounting. Further, the respective cartridges P are mounted to the corresponding mounting portions 13*f* of the pullout member 13 in such a state being arranged adjacently in one direction (the same as the direction indicate by the arrow D1 or D2).

The respective cartridges P are mounted so that the guided portion 30*c* and the guided portion 30*d* of the drive side end and the non-drive side end of the cartridges P correspond to the guide portions 13*h* and 13*j* of the corresponding mounting portions 13*f* of the pullout member 13, respectively. Further, the mounting is carried out so that the guided portions 30*e* and 30*f* correspond to guides 13*i* and 13*k*, respectively. The cartridges P are mounted into the mounting portions 13*f* thorough the guides of the respective guide portions 13*h*, 13*i*, 13*j*, and 13*k*.

Here, in this embodiment, to the most upstream in the pullout direction (indicated by the arrow D2) of the pullout member 13, the black cartridge Pk containing the developer Tk of black color is mounted. Specifically, the pullout member 13 supports the cartridge Pk at the most upstream side. As illustrated in FIG. 17, the amount of the developer Tk contained in the developer containing portion 41*k* of the cartridge Pk is relatively larger than the amounts of the developers Ty, Tm, Tc contained in the developer containing portions 41*y*, 41*m*, 41*c* of the other cartridges Py, Pm, Pc. This is because a use amount of the developer of black color is larger than the use amounts of the developers of the other colors. For that reason, the larger amount of the developer of black color is required to be contained. With such a structure, the user may be relieved of the troubles such as being necessary for frequently replacing the cartridge Pk, which is frequently used. Further, in this embodiment, capacities (developer containing capacity) of the developer containing portions 41 (41*k*, 41*y*, 41*m*, 41*c*) containing the developers are all the same among the respective cartridges P (Pk, Py, Pm, Pc). Specifically, the developer containing capacities of the developer containing portions of the plurality of cartridges are identical with each other. Among the plurality of cartridges having the same capacities, the black cartridge Pk only is increased in amount of the developer to be contained. Consequently, the developer containing portion 41 may be used commonly among the respective color cartridges 41*k*, 41*y*, 41*m*, 41*c*.

Here, in this embodiment, parts contained in the respective cartridges P (for example, drum 1, charging roller 2, cleaning means 6, development roller 40, developer supply roller 43, a frame, etc.) are common. Besides, weights per unit volume of the developers are substantially the same, even if the colors of the developers are different. Accordingly, in this embodiment, the black cartridge Pk which contains the relatively larger amount of the developer than the other cartridges is heaviest compared to the other cartridges.

(Tilt Prevention of Pullout Member)

As described above, to the most upstream of the pullout direction (indicated by the arrow D2) of the pullout member 13, the black cartridge Pk containing the developer of black color is mounted. In addition, the weight of the developer contained in the developer containing portion 41*k* of the black cartridge Pk is heavier than the weights of the developers contained in the developer containing portions 41*y*, 41*m*, 41*c* of the other cartridges.

Figure 18:
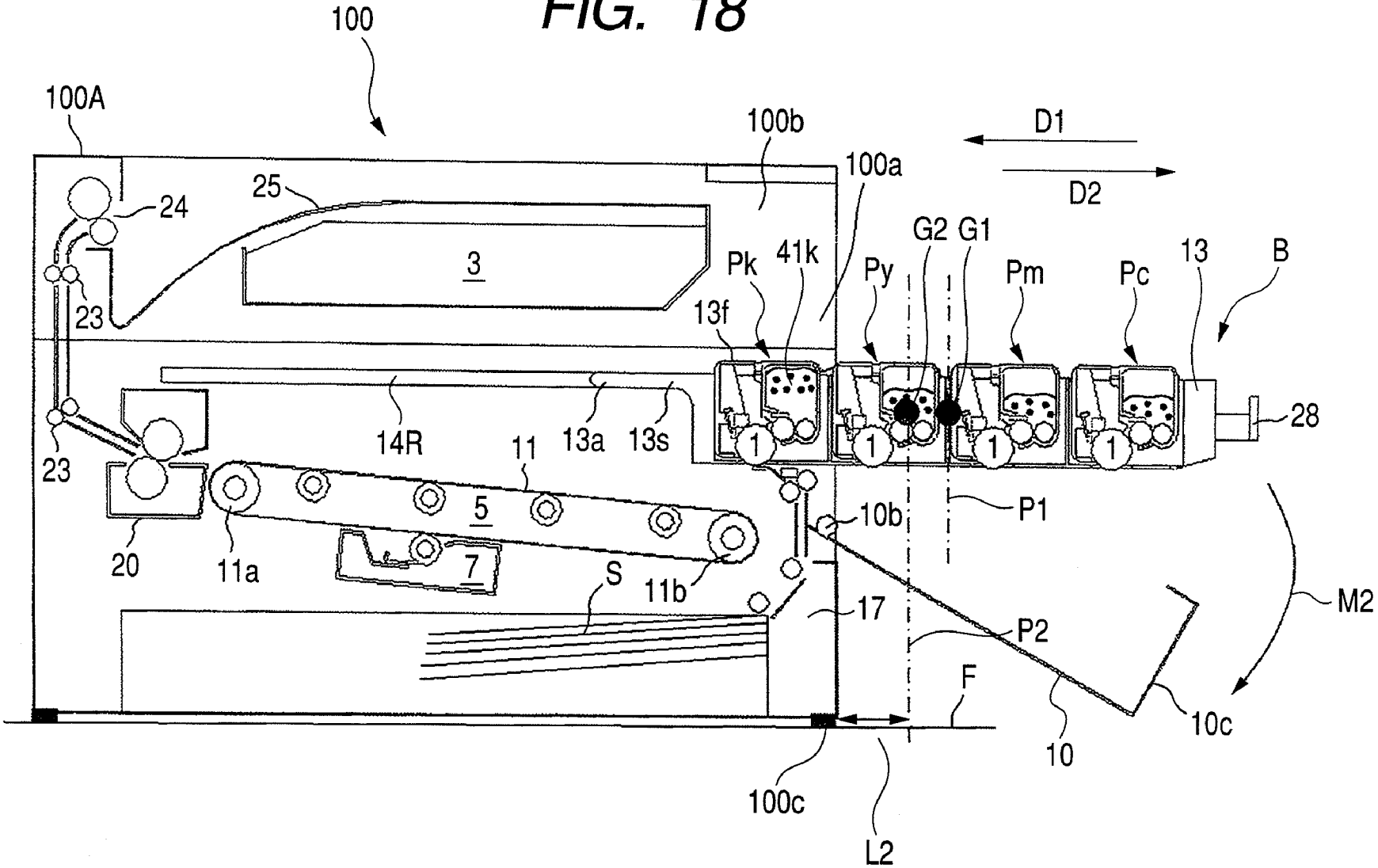
FIG. 18 is an explanatory diagram of a moment acting so that the pullout member pulled out to the pullout position is tilted.

As illustrated in FIG. 18, there is assumed a case in which the amounts of the developers contained in all the cartridges Pk, Py, Pm, Pc are the same, and the parts are common, whereby the weights of the respective cartridges P are equal. In this case, the center of gravity G1 of the pullout member 13 at the pullout position B locates at a position P1 which being substantially a center of the pullout member 13.

Contrary to this, according to this embodiment, the center of gravity G2 of the pullout member 13 may be shifted to a position P2, which is upstream than a position P1 at which the center of gravity G1 locates, in the pullout direction D2.

This is because the weight of the black cartridge Pk, which is positioned most upstream of the pullout direction, is heavier than the weight of each of the other cartridges. In other words, the center of gravity G2 may be shifted closer to the apparatus main body 100A. With this structure, the moment of the pullout member 13, which leads to tilting may be reduced.

According to this embodiment, the pullout member 13 has a structure in which its weight is supported by the guide grooves 14R and 14L through the guided portions 13*a* and 13*b* at the pullout position B illustrated in FIG. 18. In other words, the pullout member 13 is a cantilever state with the guided portions 13*a* and 13*b* being fulcrums. As described above, the guided portions 13*a* and 13*b* each having a shape extending in the pullout direction. Then, the pullout member 13 does not tilt with respect to the guide grooves 14R and 14L. For that reason, the weights of the pullout member 13 and its containers (cartridge P) generate a moment M2 about a supporting portion 100*c*, at which the apparatus main body 100 is installed, as a fulcrum and having the center of gravity G2 as an action point. The moment M2 becomes smaller as a distance L2 from the fulcrum 100*c* becomes shorter. Therefore, as described above, the moment causing the pullout member 13 to tilt may be reduced by the center of gravity G2 than the center of gravity G1.

Here, as an example of the supporting portion 100*c*, a leg portion, as illustrated in FIG. 18, extending downwardly in a vertical direction is employed. However, if a bottom surface of the apparatus main body 100A has a flat surface shape, and an overall bottom surface is used as an installation surface, a portion in the bottom surface, which is nearest to the pullout member 13, becomes a supporting portion.

As described above, in this embodiment, the weight of the cartridge Pk, which is positioned most upstream of the pullout member 13 in the pullout direction, is made heavier than the weight of each of the other cartridges Py, Pm, Pc. With this structure, there was realized a structure in which the pullout member 13 is hardly tilted downwardly (weight direction) when the pullout member 13 is pulled out to the pullout position.

Further, when enhancing the rigidity of the apparatus main body in order to prevent the pullout member 13 from tilting down due to the gravitational force at the pullout position B, the degree thereof may be reduced. Thus, it is possible to reduce necessities of, in order to enhance the rigidity, enlarging sizes of the members within the apparatus main body 100A, employing more expensive member capable of enhancing the rigidity, or of adding the number of members for securing the rigidity. Specifically, when designing the apparatus main body 100A, the moment at the pullout position is calculated, presuming that the weight of the cartridges P to be mounted inside the pullout member 13 is heaviest, namely, presuming a case being a brand-new state. On the basis of the moment, places for supporting the pullout member 13 (for example, guide members 14R and 14L) within the apparatus main body, are designed. Accordingly, the weight of the cartridge, which is positioned most upstream of the pullout direction, is made heavier than the weight of each of the other cartridges. As a result, an initial moment to be generated to the pullout member 13 may be made smaller. Thus, as described above, such necessities as reinforcing the apparatus main body 100A, or enhancing the rigidity of the apparatus main body 100A may be reduced. As a result, downsizing and cost reduction of the apparatus main body 100A may be realized.

(Mounting and Detaching of Black Cartridge Pk)

As illustrated in FIG. 6, FIG. 7, FIG. 8, and FIG. 18, the cartridge Pk is in a state being positioned within the apparatus main body 100A at the pullout position B of the pullout member 13. In other words, in the pullout position B of the pullout member 13, the cartridge Pk is positioned at an inner side of the apparatus main body than the supporting portion 100*c* of the apparatus main body 100A. On the other hand, the top opening portion 100*b* is provided above the black cartridge Pk of the apparatus main body 100A so that the black cartridge Pk may be mounted and detached through the opening portion 100*b*. In other words, the cartridge Pk may be removed upwardly from the opening portion 100*b* in a state being positioned within the apparatus main body 100A.

Here, the upward direction includes not only a vertical upward direction, but also includes the removal obliquely from the above. Besides, the opening portion 100*b* is a space, which is provided above the cartridge Pk, and indicates a space, which is the inner side than the supporting portion 100*c* within the apparatus main body 100A. In other words, only required is a structure in which there is no space that blocks the mounting and detaching of the cartridge Pk upwardly, in a state in which the cartridge Pk is positioned within the apparatus main body 100A.

As described above, there is employed a structure in which the cartridge Pk may be mounted and detached without pulling-out the pullout member 13 very much. Consequently, the moment to be generated to the pullout member 13 may be made smaller, whereby the pullout member 13 is hardly tilted.

Second Embodiment

Next, a second embodiment will be described. Note that, in this embodiment, a description will be provided of the structure and operation, which are different from the first embodiment described above, and the members having the same structure and function are designated by the same reference symbols, and the previous description in the first embodiment is invoked.

Description will be provided of points in which the second embodiment largely differs from the first embodiment. In the first embodiment, a description will be provided of a system in which, among the respective cartridges P (Pk, Py, Pm, Pc), the developer containing capacities of the developer containing portions 41 (41*k*, 41*y*, 41*m*, 41*c*) containing the developers T (Tk, Ty, Tm, Tc) are all the same. In the second embodiment, a description will be provided of an example in which only the developer containing portion 41*k* of the cartridge Pk at the most upstream of the pullout direction of the pullout member 13 has a shape which differs from the developer containing portions 41*y*, 41*m*, 41*c* of the other cartridges Py, Pm, and Pc.

Figure 19:
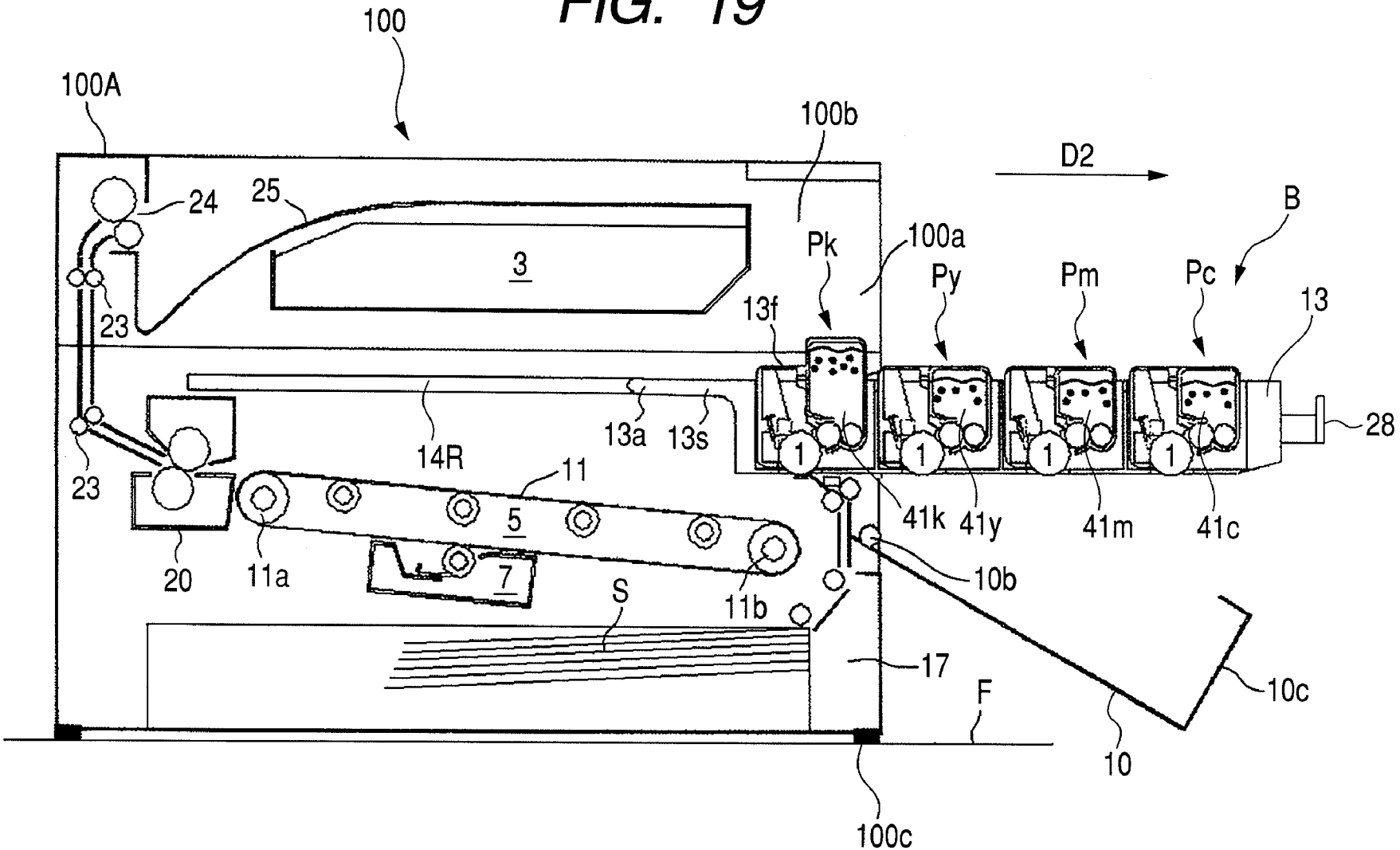
FIG. 19 is a diagram illustrating an image forming apparatus according to a second embodiment of the present invention.

FIG. 19 illustrates the pullout member 13 at the pullout position B, and the cartridges P (Pk, Py, Pm, Pc) mounted therein. The respective cartridges P contain the developers of the respective colors within the developer containing portions 41 (41*k*, 41*y*, 41*m*, 41*c*).

The cartridge Pk is mounted most upstream in the pullout direction (indicated by the arrow D2) of the pullout member 13. In addition, the weight of the developer, which is contained in the developer containing portion 41*k* of the cartridge Pk, is heavier compared to the weight of the developer, which is contained in each of the developer containing portions 41*y*, 41*m*, 41*c* of the other cartridges Py, Pm, Pc.

Accordingly, similar to the first embodiment, there was realized a structure in which the pullout member 13 is hardly tilted downwardly when the pullout member 13 is pulled-out to the pullout position B.

Besides, the shape of the developer containing portion 41*k* is different from the shapes of the developer containing portions 41*y*, 41*m*, 41*c* of the other cartridges Py, Pm, Pc. Specifically, as illustrated in FIG. 19, the developer containing portion 41*k* extends (projects) vertically upwardly (orthogonal direction to pullout direction) than the developer containing portions 41*y*, 41*m*, 41*c*. Therefore, the developer containing portion 41*k* may contain therein the more developer. In other words, the amount of the developer to be contained in the inside of each of the developer containing portions 41*y*, 41*m*, 41*c* is not more than the cartridge Pk. Accordingly, the developer containing portions are configured to be smaller in proportion thereto. As described above, the developer containing portion 41*k* of the cartridge Pk positioned at the most upstream has a shape which is orthogonal to the pullout direction D2 and projects more upwardly than the each of the developer containing portions 41*y*, 41*m*, 41*c* of the other cartridges Py, Pm, Pc.

Like this, the each of the developer containing portions 41*y*, 41*m*, 41*c* is configured to be smaller than the developer containing portion 41*k*. With this structure, the developer containing portions are free from making uselessly larger, thereby being capable of reducing costs. In addition, the developer containing portions 41*y*, 41*m*, 41*c* may be prevented from becoming uselessly larger, and hence the weight itself of each of the developer containing portions 41*y*, 41*m*, 41*c* may be made smaller. In other words, such a moment that the pullout member 13 tends to tilt downward (in the gravity direction) may be reduced when the pullout member 13 is pulled-out to the pullout position B.

Third Embodiment

Next, a description will be provided of a third embodiment. Note that, in this embodiment, a description will be provided of the structure and operation, which are different from the first and second embodiments described above, and the members having the same structure and function are designated by the same reference symbols, and the previous descriptions in the first and second embodiments are invoked.

Description will be provided of points in which the third embodiment differs from the second embodiment. In the second embodiment, a description will be provided of an example in which the developer containing portion 41*k* of the cartridge Pk, which is supported (mounted) most upstream of the pullout direction of the pullout member 13, is extended vertically upwardly. In the third embodiment, a description will be provided of an example in which the developer containing portion 41*k* of the cartridge Pk, which is supported most upstream in the pullout direction of the pullout member 13, is extended in a horizontal direction (a direction parallel to the pullout direction).

Figure 20:
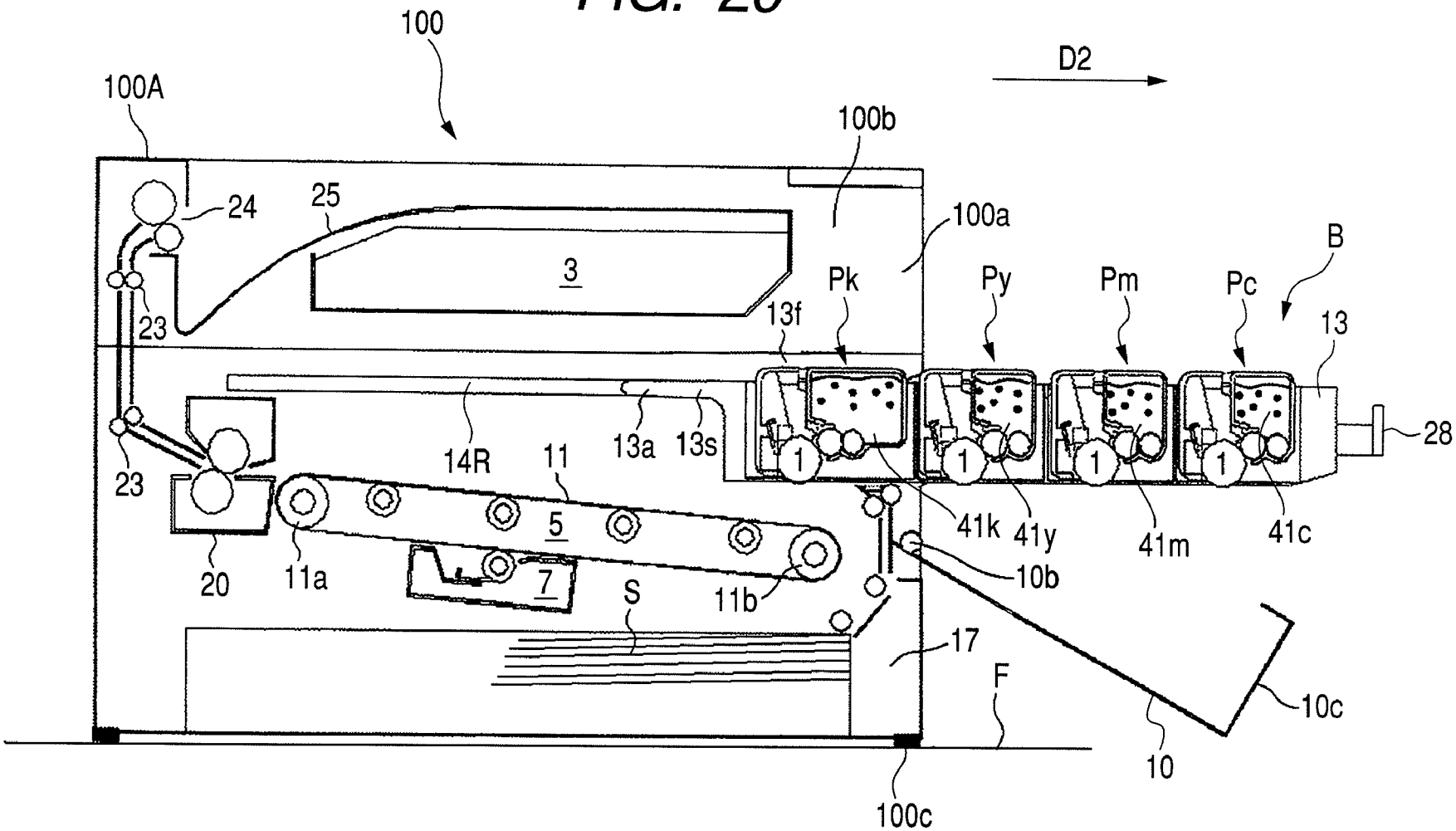
FIG. 20 is a diagram illustrating an image forming apparatus according to a third embodiment of the present invention.

FIG. 20 illustrates the pullout member 13 at the pullout position B, and the cartridges P (Pk, Py, Pm, Pc) mounted therein. The respective cartridges P contain the developers of the respective colors within the developer containing portions 41 (41*k*, 41*y*, 41*m*, 41*c*).

The black cartridge Pk containing the developer of black color is mounted most upstream in the pullout direction (indicated by the arrow D2) of the pullout member 13. In addition, the weight of the developer, which is contained in the developer containing portion 41*k* of the cartridge Pk, is heavier compared to the weight of the developer, which is contained in each of the developer containing portions 41*y*, 41*m*, 41*c* of the other cartridges Py, Pm, Pc. The developer containing portion 41*k* of the cartridge Pk has a larger shape than the developer containing portions 41*y*, 41*m*, 41*c* of the other cartridges Py, Pm, Pc along the pullout direction D2.

Accordingly, similar to the first and second embodiments, there was realized a structure in which the pullout member 13 is hardly tilted downwardly when the pullout member 13 is pulled-out to the pullout position B.

Similar to the second embodiment, the shape of the developer containing portion 41*k* is different from the shapes of the developer containing portions 41*y*, 41*m*, 41*c*. Specifically, as illustrated in FIG. 20, the developer containing portion 41*k* extends horizontally (in the direction in which the cartridges are adjacently disposed) than the developer containing portions 41*y*, 41*m*, 41*c*. Therefore, the developer containing portion 41*k* may contain therein the more developer than the developer containing portions 41*y*, 41*m*, 41*c*.

Similar to the second embodiment, only the developer containing portion 41*k* is made to have a different shape with the developer containing portions 41*y*, 41*m*, 41*c*. With this structure, the developer containing portions 41*y*, 41*m*, 41*c* are free from making uselessly larger, thereby being capable of reducing costs. Further, the developer containing portions 41*y*, 41*m*, 41*c* may be prevented from becoming uselessly larger. Thus, the weight itself of each of the developer containing portions 41*y*, 41*m*, 41*c* may be made smaller. In other words, such a moment that the pullout member 13 tends to tilt downward may be reduced when the pullout member 13 is pulled-out to the pullout position B.

Further to the second embodiment, in the third embodiment, the developer containing portion 41*k* is extended in a direction parallel to the pullout direction D2. In the second embodiment, as the developer containing portion 41*k* extends vertically and upwardly, a useless space (dead space) exists vertically above the other cartridges Py, Pm, and Pc. Contrary to this, in the third embodiment, there is no such a space. Consequently, in the third embodiment, the space of the vertical direction may be effectively used.

In the above-mentioned respective embodiments, the heaviest cartridge Pk contains the much developer than the other cartridges Py, Pm, Pc. However, the present invention is not limited to the structure described above. For example, the parts contained in the heaviest cartridge P may be heavier than the parts contained in the other cartridges.

[Others]

The number of the plurality of cartridges, which are arranged adjacently in one direction and supported by the pullout member 13 is not limited to four of the embodiments. The present invention may be adopted to a case in which the number of the cartridges is set to two or three, or even in a case of five or more.

The contact and separation between the drum 1 and the belt 11 in the above-mentioned embodiments may be carried out with a system in which the pullout member 13 supporting the plurality of cartridges is moved with respect to the belt unit 5. Otherwise, there may employ a system in which both the belt unit 5 and the pullout member 13 are moved.

Further, in the above-mentioned embodiments, the belt unit 5 is used as an intermediate transfer belt unit. In addition thereto, the present invention may be adopted to a structure of the image forming apparatus in which the developer image of the respective colors, which is superimposingly transferred with respect to the intermediate transfer belt, is retransferred (secondary transfer) onto the recording medium S.

Further, in the above-mentioned respective embodiments, a description will be provided of a case, as an example, in which the parts of the respective cartridges P are commonly used, and the weights of the cartridges P are made differ by using the difference of the developer amount. However, the present invention is not limited thereto. The present invention may also be adopted to a case in which the developer amounts of the respective cartridges P are the same, but the weights of the parts of the respective cartridges P differ. In addition, the present invention may also be adopted a case in which weights per unit volume of the developers differ. In other words, according to the present invention, there may take a structure in which the heaviest cartridge is supported most upstream of the pullout direction of the cartridge supporting member (pullout member 13). According to the present invention, it is possible to realize the above-mentioned effects.

Here, the first embodiment is invoked to describe this embodiment with reference to FIG. 1 to FIG. 17.

This embodiment is similar to the first to third embodiments in a point that the heaviest cartridge Pk is supported most upstream in the pullout direction D2. However, in this embodiment, the parts contained in the cartridge Pk are heavier than the parts contained in the other cartridges Py, Pm, Pc. Note that, the developer amount contained in the cartridge Pk is the same as the developer amount contained in the each of the other cartridges. Accordingly, the cartridge Pk is heavier than the other cartridges Py, Pm, Pc. The above-mentioned parts include at least one or a combination of the plurality of parts selected from the electrophotographic photosensitive drum 1, the charging roller 2, the cleaning blade 6, the development roller 40, the developer supply roller 43, and the cartridge frame 300 (for example, FIG. 11), which are contained in the above-mentioned cartridge. Then, the total weight of the cartridge Pk is heavier than the total weight of the each of the other cartridges Py, Pm, Pc. Even in this embodiment, it is possible to realize the above-mentioned effects.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-322012, filed Dec. 18, 2008 which is hereby incorporated by reference herein its entirety.

What is claimed is:

1. A color electrophotographic image forming apparatus in which a plurality of cartridges are detachably mounted to an apparatus main body to form an image on a recording medium, the color electrophotographic image forming apparatus comprising:

a cartridge supporting member detachably supporting the plurality of cartridges and movable between an inside position in which the cartridge supporting member is inside the apparatus main body and a pullout position in which the cartridge supporting member is pulled out from the inside position to an outside of the apparatus main body; and a first opening portion through which the cartridge supporting member passes, wherein the plurality of cartridges are arranged side-by-side and supported on the cartridge supporting member so that a longitudinal direction of each of the plurality of cartridges is orthogonal to a pullout direction, of the cartridge supporting member in which the cartridge supporting member moves from the inside position to the pullout position, and a cartridge, which is heaviest among the plurality of cartridges, is supported most upstream of the pullout direction, and in a state in which the cartridge supporting member is positioned at the pullout position, the heaviest cartridge is positioned inside the apparatus main body, and a second opening portion is located above the heaviest cartridge.

2. A color electrophotographic image forming apparatus in which a plurality of cartridges are detachably mounted to an apparatus main body to form an image on a recording medium, the color electrophotographic image forming apparatus comprising:

a cartridge supporting member detachably supporting the plurality of cartridges and movable between an inside position in which the cartridge supporting member is inside the apparatus main body and a pullout position in which the cartridge supporting member is pulled out from the inside position to an outside of the apparatus main body, wherein the plurality of cartridges are arranged side-by-side and supported on the cartridge supporting member so that a longitudinal direction of each of the plurality of cartridges is orthogonal to a pullout direction of the cartridge supporting member in which the cartridge supporting member moves from the inside position to the pullout position, and a cartridge, which is heaviest among the plurality of cartridges, is supported most upstream of the pullout direction, and in a state in which the cartridge supporting member is positioned at the pullout position, the heaviest cartridge is positioned inside the apparatus main body and other cartridges than the heaviest cartridge are positioned outside the apparatus main body.

3. A color electrophotographic image forming apparatus according to claim 2, further comprising a first opening portion and a second opening portion provided in the apparatus main body, wherein the first opening portion allows the cartridge supporting member to pass therethrough, and the second opening portion is located above the heaviest cartridge, which is positioned inside the apparatus main body in the state in which the cartridge supporting member is positioned at the pullout position.

4. A color electrophotographic image forming apparatus according to claim 2, further comprising a first main body side support member and a second main body side support member, which are provided opposite to each other inside the apparatus main body for movably supporting the cartridge supporting member, wherein the cartridge supporting member has a guided member, which is provided on a most upstream side in the pullout direction, over an entire width in a direction orthogonal to the pullout direction, and is projected toward upstream in the pullout direction, and the cartridge supporting member has a first guided portion on one end of the guided member and a second guided portion on the other end of the guided member in the direction orthogonal to the pullout direction, and the first main body side support member and the second main body side support member support the first guided portion and the second guided portion, respectively, to movably support the cartridge supporting member.

5. A color electrophotographic image forming apparatus according to claim 4, wherein the first guided portion and the second guided portion each extends along the pullout direction.

6. A color electrophotographic image forming apparatus according to claim 5, wherein the cartridge supporting member further comprises a third guided portion projecting, in the direction orthogonal to the pullout direction, from one end of the cartridge supporting member downstream in the pullout direction and a fourth guided portion projecting, in the orthogonal direction, from the other end of the cartridge supporting member, and the first main body side support member and the second main body side support member support the third guided portion and the fourth guided portion, respectively, to movably support the cartridge supporting member.

7. A color electrophotographic image forming apparatus according to claim 2, wherein the heaviest cartridge contains a larger amount of a developer than the other cartridges.

8. A color electrophotographic image forming apparatus according to claim 2, wherein a developer containing portion of the cartridge positioned most upstream has a shape different from a shape of each of developer containing portions of the other cartridges.

9. A color electrophotographic image forming apparatus according to claim 8, wherein the developer containing portion of the cartridge positioned most upstream has a shape, which extends in the direction orthogonal to the pullout direction and projects upwardly more than each of the developer containing portions of the other cartridges.

10. A color electrophotographic image forming apparatus according to claim 8, wherein the developer containing portion of the cartridge positioned most upstream has a shape, which is larger in size along the pullout direction than each of the developer containing portions of the other cartridges.

11. A color electrophotographic image forming apparatus according to claim 2, wherein a part of the heaviest cartridge is heavier than a part of each of the other cartridges.

12. A color electrophotographic image forming apparatus according to claim 11, wherein the part comprises at least one or a combination of two or more selected from a group consisting of: an electrophotographic photosensitive drum; a charging roller; a cleaning blade; a development roller; a developer supply roller; and a cartridge frame of each of the plurality of cartridges.

* * * * *